US006105386A

United States Patent [19]

Kuroda et al.

[11] Patent Number: 6,105,386

[45] Date of Patent: Aug. 22, 2000

[54] SUPERCRITICAL REFRIGERATING APPARATUS

[75] Inventors: Yasutaka Kuroda; Shin Nishida, both of Anjo, Japan

[73] Assignee: Denso Corporation, Kariya, Japan

[21] Appl. No.: 09/185,934

[22] Filed: Nov. 4, 1998

[30] Foreign Application Priority Data

Nov. 6, 1997 [JP] Japan ..... 9-304536

[51] Int. Cl.[7] ..... F25B 41/00

[52] U.S. Cl. ..... 62/513; 62/113; 62/196.1

[58] Field of Search ..... 62/513, 113, 196.1, 62/DIG. 17

[56] References Cited

U.S. PATENT DOCUMENTS 5,245,836 9/1993 Lorentzen et al. .

5,479,789 1/1996 Borten et al. ..... 62/324.1

FOREIGN PATENT DOCUMENTS 0 701 096 A2 3/1996 European Pat. Off. .

0 779481 A2 6/1997 European Pat. Off. .

90/07683 7/1990 WIPO .

99/34156 7/1999 WIPO .

*Primary Examiner*—William Doerrler

*Assistant Examiner*—Marc Norman

*Attorney, Agent, or Firm*—Harness, Dickey & Pierce, PLC

[57] ABSTRACT

The supercritical refrigerating apparatus has refrigerant bypass means for bypassing a heat exchanger according to a physical value of the refrigerant. Therefore, the temperature of refrigerant on a suction side of the compressor becomes lower than that of refrigerant sucked into the compressor via the heat exchanger. As a result, the refrigerant temperature in a refrigerant passage extending from a suction side to a discharge side of the compressor is decreased, thereby preventing breakage of the compressor.

6 Claims, 19 Drawing Sheets

SUPERCRITICAL REFRIGERATING APPARATUS

CROSS REFERENCE TO RELATED APPLICATIONS

This application is based upon and claims priority from Japanese patent application No. Hei 9-304536, filed Nov. 6, 1997, the entire contents of which are incorporated herein by reference.

BACKGROUND OF THE INVENTION

1. Field of the Invention

The present invention relates to a vapor compression refrigerating apparatus (supercritical refrigerating apparatus) in which a pressure inside a gas cooler exceeds a critical pressure of a refrigerant. The present invention is applicable to a supercritical refrigerating cycle using carbon dioxide (hereinafter referred to as $CO_2$) as a refrigerant (hereinafter referred to as $CO_2$ cycle).

2. Description of Related Art

Theoretically, an operation of the $CO_2$ cycle is the same as that of a conventional vapor compression refrigerating cycle using fron. That is, as indicated by line A-B-C-D-A in FIG. 24 (Mollier diagram for $CO_2$), gas phase $CO_2$ is compressed by a compressor (A-B), and then the gas cooler cools this high-temperature high-pressure supercritical phase $CO_2$ (B-C).

The high-temperature high-pressure supercritical phase $CO_2$ is decompressed by a pressure control valve (C-D) to become gas-liquid two-phase $CO_2$. The gas-liquid two-phase $CO_2$ is evaporated (D-A) while absorbing evaporation latent heat from external fluid such as air so that external fluid is cooled. $CO_2$ starts phase transition from supercritical phase to gas-liquid two-phase when a pressure of $CO_2$ becomes lower than a saturated liquid pressure (pressure at a cross point between line segment CD and saturated liquid line SL). Therefore, when $CO_2$ performs phase transition from phase C to phase D at a slow speed, $CO_2$ changes from supercritical phase to gas-liquid two-phase via liquid phase.

In supercritical phase, $CO_2$ molecules move as if in gas phase even though a density of $CO_2$ is substantially the same as that in liquid phase.

However, the critical temperature of $CO_2$ is approximately 31° C., which is lower than a critical temperature of the conventional fron (for example, 112° C. for R-12). Therefore, a temperature of $CO_2$ on a gas cooler side becomes higher than the critical temperature of $CO_2$ during summer season or the like. Accordingly, $CO_2$ does not condense at an outlet side of the gas cooler (line segment BC does not cross the saturated liquid line).

Furthermore, a condition of $CO_2$ at the outlet side of the gas cooler (at point C) is determined according to a discharge pressure of the compressor and a $CO_2$ temperature at the outlet side of the gas cooler. The temperature of $CO_2$ at the outlet side of the gas cooler is determined by radiation performance of the gas cooler and an outside air temperature. Since the outside air temperature can not be controlled, the $CO_2$ temperature at the outlet side of the gas cooler can not be virtually controlled.

Therefore, the condition of $CO_2$ at the outlet side of the gas cooler (at point C) can be controlled by controlling the discharge pressure of the compressor (pressure on the gas cooler outlet side). In other words, when the outside air temperature is high during summer season or the like, the pressure of the gas cooler outlet side needs to be increased as indicated by the line E-F-G-H-E in FIG. 24, so that sufficient cooling performance (enthalpy difference) is obtained.

However, to increase the pressure on the gas cooler outlet side, the discharge pressure of the compressor has to be increased, as described above, resulting in increase in compression work (amount of enthalpy change $\Delta L$ during the compression) of the compressor. Therefore, when an increasing amount of enthalpy change $\Delta i$ during evaporation (D-A) is larger than an increasing amount of enthalpy change $\Delta L$ during compression (A-B), a performance coefficient ($COP=\Delta i/\Delta L$) of the $CO_2$ cycle deteriorates.

When calculating a relationship between the pressure of $CO_2$ at the outlet side of the gas cooler and the performance coefficient by using FIG. 24, while setting the temperature of $CO_2$ at the outlet side of the gas cooler to 40° C., for example, the performance coefficient becomes the maximum at pressure P1 (approximately 10 MPa) as indicated by a solid line in FIG. 25. Similarly, when the temperature of $CO_2$ at the outlet side of the gas cooler is set to 30° C., the performance coefficient becomes the maximum at pressure P2 (approximately 9.0 MPa) as indicated by a broken line in FIG. 25.

Thus, each pressure in which the performance coefficient becomes the maximum is calculated for various temperatures of $CO_2$ on the outlet side of the gas cooler in the above-mentioned method. The result is indicated by bold solid line $\eta_{max}$ (hereinafter referred to as optimum control line $\eta_{max}$) in FIG. 24. Therefore, for an efficient operation of the $CO_2$ cycle, the pressure on the outlet side of the gas cooler and the $CO_2$ temperature on the outlet side of the gas cooler need to be controlled as indicated by the optimum control line $\eta_{max}$.

The optimum control line $\eta_{max}$ is calculated so that a supercooling degree (subcooling) is approximately 3° C. in a condensing area (area below the critical pressure) when the pressure on the evaporator side is approximately 3.5 MPa (corresponding to that a temperature of the evaporator is 0° C.). Furthermore, FIG. 26 shows the optimum control line $\eta_{max}$ drawn on Cartesian coordinates having the temperature of $CO_2$ on the gas cooler outlet side and the pressure on the gas cooler outlet side as variables. As obviously understood from FIG. 26, the pressure on the gas cooler outlet side needs to be increased as the temperature of $CO_2$ on the gas cooler outlet side increases.

A pressure control unit for controlling a pressure on an outlet side of the gas cooler of a $CO_2$ cycle has already been disclosed in U.S. patent application Ser. No. 08/789,210 filed Jan. 24, 1997 (corresponding Japanese patent application No. Hei 8-11248) by the inventors of the present invention et al.

In the $CO_2$ cycle (see line A'-B'-C-D in FIG. 27), heat exchange between $CO_2$ discharged from the evaporator (hereinafter referred to as low-pressure $CO_2$) and $CO_2$ discharged from the gas cooler (hereinafter referred to as high-pressure $CO_2$) is performed so that enthalpy of $CO_2$ at the inlet side of the evaporator is reduced, thereby increasing an enthalpy difference between the inlet and outlet sides of the evaporator to improve the cooling performance of the $CO_2$ cycle.

However, when the inventors reviewed such $CO_2$ cycle, it was found that the $CO_2$ cycle may have the following problems.

In the above-mentioned $CO_2$ cycle, the low-pressure $CO_2$ has a preset heating degree of 0° C. or more due to heat exchange between the low-pressure $CO_2$ and the high-pressure $CO_2$, unlike in a $CO_2$ cycle in which heat exchange between the low-pressure $CO_2$ and the high-pressure $CO_2$ is not performed (see line A-B-C-D in FIG. 27).

On the other hand, the pressure control unit controls the pressure on the gas cooler outlet side according to the temperature of $CO_2$ on the gas cooler outlet side. Therefore, the pressure control unit does not immediately reduce the pressure on the gas cooler outlet side even if the temperature of the low-pressure $CO_2$ decreases as the heat load of the evaporator decreases and the pressure inside the evaporator decreases, but controls the pressure on the gas cooler outlet side according to the present temperature of $CO_2$ on the gas cooler outlet side.

As a result, if the temperature of $CO_2$ on the gas cooler outlet side does not change, the pressure on the gas cooler outlet side does not change either. Therefore, as shown in FIG. 30, when the heat load of the evaporator decreases, the temperature of $CO_2$ increases in a $CO_2$ passage extending from a suction side to a discharge side of the compressor. When the temperature of $CO_2$ in the $CO_2$ passage of the compressor is increased, shortage of oil film tends to occur at a sliding portion of the compressor, resulting in breakage of the compressor.

When the temperature of $CO_2$ on the gas cooler inlet side increases, the temperature of $CO_2$ on the gas cooler outlet side also increases. Therefore, when the heat load of the evaporator decreases, the pressure control unit increases the pressure on the gas cooler outlet side because the pressure control unit does not immediately respond to the temperature of the low-pressure $CO_2$. Thus, the temperature of $CO_2$ in the $CO_2$ passage of the compressor may increase as the heat load of the evaporator decreases.

SUMMARY OF THE INVENTION

The present invention is made in light of the foregoing problem, and it is an object of the present invention to provide a supercritical refrigerating apparatus, which prevents the breakage of a compressor, having a pressure control unit for controlling a pressure on an outlet side of a gas cooler according to a temperature on the outlet side of the gas cooler.

According to the supercritical refrigerating apparatus of the present invention, the supercritical refrigerating apparatus has refrigerant bypass means for bypassing a heat exchanger according to a physical value of the refrigerant.

Therefore, the temperature of refrigerant on a suction side of the compressor becomes lower than that of refrigerant sucked into the compressor via the heat exchanger. As a result, the refrigerant temperature in a refrigerant passage extending from a suction side to a discharge side of the compressor is decreased, thereby preventing breakage of the compressor.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Embodiments of the present invention will be described hereinafter with reference to the drawings.

First Embodiment

Figure 1:
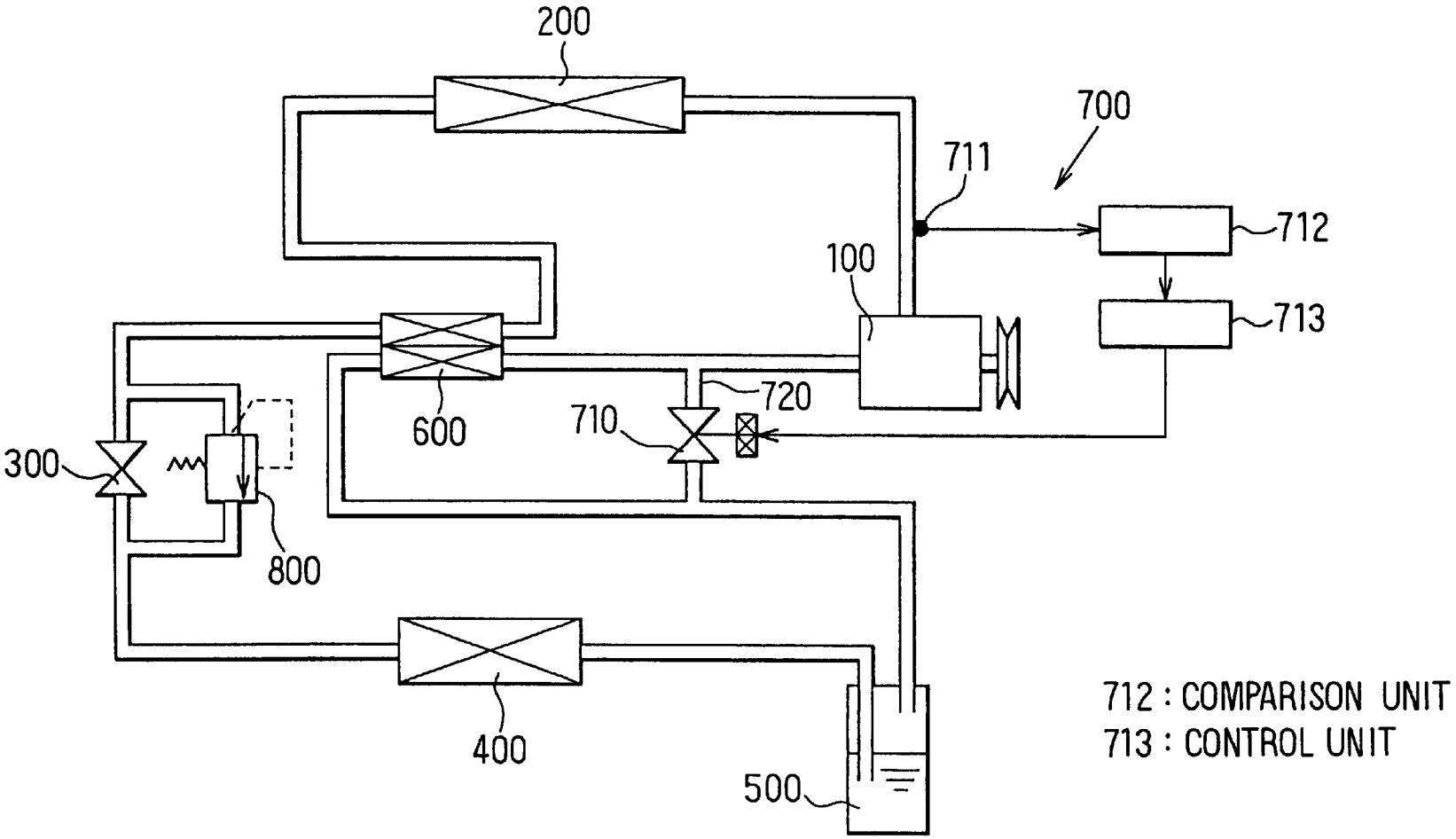
FIG. 1 is a schematic view showing a supercritical refrigerating cycle according to a first embodiment of the present invention.

A first embodiment of the present invention is shown in FIGS. 1 through 7. As shown in FIG. 1, a $CO_2$ cycle according to the first embodiment of the present invention is applied to an air conditioning apparatus for a vehicle.

A compressor 100 is driven by an engine for driving the vehicle to compress gas phase $CO_2$. A gas cooler 200, which functions as a radiator, cools the $CO_2$ compressed by the compressor 100 through heat exchange between the $CO_2$ and outside air. A pressure control valve (pressure control unit) 300 controls a pressure on an outlet side of the gas cooler 200 according to a temperature of $CO_2$ at the outlet side of the gas cooler 200. The pressure control valve (expansion valve) 300 also functions as a decompressor to decompress $CO_2$ into low-temperature low-pressure gas-liquid two-phase $CO_2$.

An evaporator (heat sink) 400 functions as air cooling means for cooling air inside a passenger compartment of the vehicle. The gas-liquid two-phase $CO_2$ is vaporized (evaporated) within the evaporator 400, while absorbing evaporation latent heat from air inside the passenger compartment so that air inside the passenger compartment is cooled. An accumulator (gas-liquid separator) 500 separates gas-liquid two-phase $CO_2$ into gas phase $CO_2$ and liquid phase $CO_2$, and temporarily accumulates liquid phase $CO_2$ therein. Separated gas phase $CO_2$ is discharged from the accumulator 500 to a suction side of the compressor 100.

An internal heat exchanger 600 performs heat exchange between the $CO_2$ discharged from the accumulator 500 to be sucked into the compressor 100 and the $CO_2$ discharged from the gas cooler 200. An electromagnetic valve (valve means) 710 opens and closes a bypass passage 720 through which the $CO_2$ discharged from the accumulator 500 flows to bypass the internal heat exchanger 600.

Figure 2:
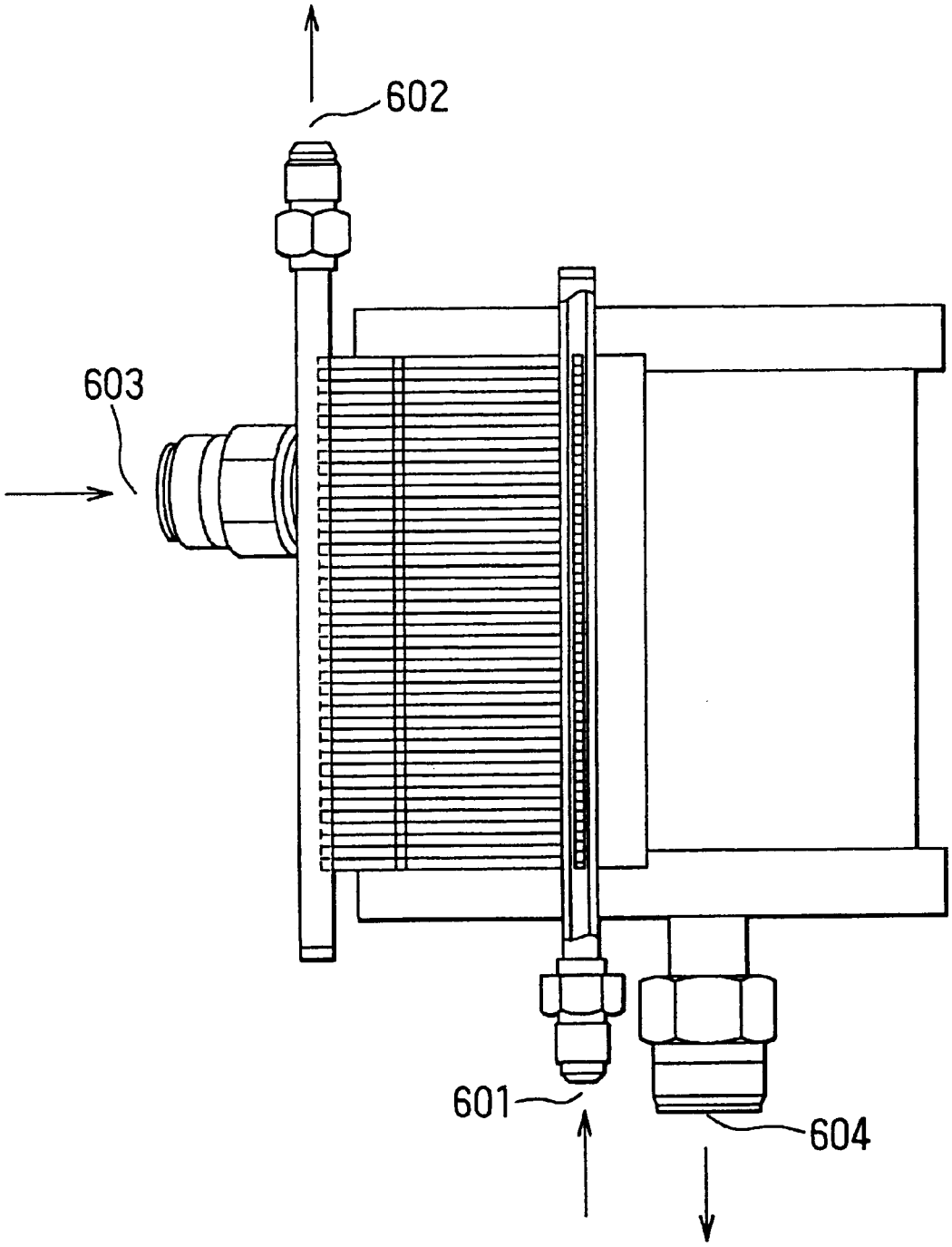
FIG. 2 is an explanatory view showing an internal heat exchanger according to the first embodiment of the present invention.

A spiral-shaped $CO_2$ passage is disposed in the internal heat exchanger 600 in such a manner that a high-pressure $CO_2$ passage and a low-pressure $CO_2$ passage are parallel to each other. As shown in FIG. 2, the internal heat exchanger 600 has a high-pressure inlet 601 connecting to the gas cooler 200, a high-pressure outlet 602 connecting to the pressure control valve 300, a low-pressure inlet 603 connecting to the accumulator 500, and a low-pressure outlet 604 connecting to the compressor 100.

A thermistor-type temperature sensor (temperature detector) 711 detects a temperature of $CO_2$ on the discharge side of the compressor 100. Detection signals of the temperature sensor 711 are input into a comparison unit 712. The comparison unit 712 sends a signal to a control unit 713 when comparison unit 712 determines that the temperature of $CO_2$ corresponding to the detection signal of the temperature sensor 711 is equal to or more than a preset temperature T (120° C. in the first embodiment). The control unit 713 controls opening and closing of the electromagnetic valve 710.

The control unit 713 opens the electromagnetic valve 710 when the signal sent from the comparison unit 712 is input into the control unit 713, and closes the electromagnetic valve 710 when the signal is not input into the control unit 713. Hereinafter, the parts 710–713, 720 are collectively referred to as refrigerant bypass means. The preset temperature T is not limited to 120° C., but may be suitably determined in consideration of abrasion resistance of the compressor 100 and heat resistance of lubricating oil.

When the pressure on the outlet side of the gas cooler 200 excessively increases due to malfunction of the pressure control valve 300 or the like, $CO_2$ flows through a relief valve 800 to bypass the pressure control valve 300.

A structure of the pressure control valve 300 will be described with reference to FIG. 3.

A casing 301 forms a part of a $CO_2$ passage 6*a* extending from the gas cooler 200 to the evaporator 400, and accommodates an element case 315 described later. An upper lid 301*a* has an inlet 301*b* connected to the gas cooler 200. A casing main portion 301*c* has an outlet 301*d* connected to the evaporator 400.

The casing 301 has a partition wall 302 for partitioning the $CO_2$ passage 6*a* into an upstream side space 301*e* and a downstream side space 301*f*. The partition wall 302 has a valve orifice 303, through which the upstream side space 301*e* and the downstream side space 301*f* are communicated with each other.

The valve orifice 303 is opened and closed by a needle valve having a shape of a needle (hereinafter refereed to as valve) 304. The valve 303 and a diaphragm 306 described later closes the valve orifice 303 when the diaphragm 306 moves from a neutral position toward the valve 303 (the other end of the diaphragm 306 in a thickness direction). An opening degree of the valve orifice 303 (displacement of the valve 304 from a position of the valve 304 when the valve orifice 303 is fully closed) becomes the maximum when the diaphragm 306 moves toward one end of the diaphragm 306 in the thickness direction.

A closed space (gas-filled room) 305 is formed inside the upstream side space 301*e*. The closed space 305 consists of the thin-film diaphragm (moving member) 306 made of stainless steel, and a diaphragm upper-side supporting member (forming member) 307 disposed on a side of the one end of the diaphragm 306 in the thickness direction. The diaphragm 306 is deformed and displaced according to a pressure difference between inside and outside pressures of the closed space 305.

Figure 4:
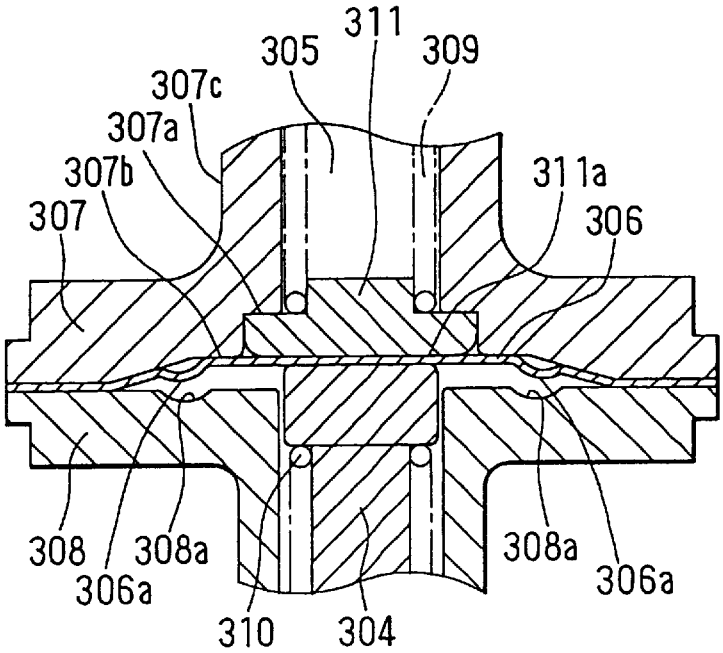
FIG. 4 is an enlarged partial view showing a diaphragm portion when a valve is opened according to the first embodiment of the present invention.
Figure 5:
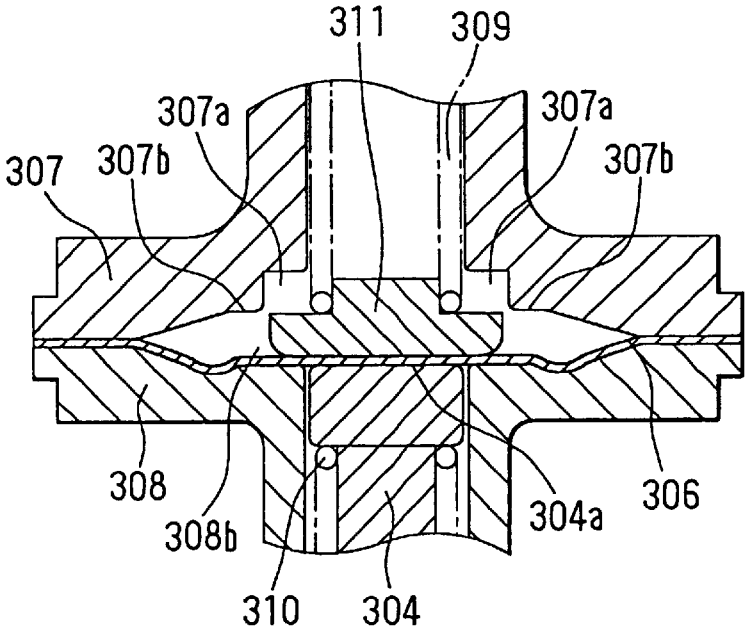
FIG. 5 is an enlarged partial view showing the diaphragm portion when the valve is closed according to the first embodiment of the present invention.

On a side of the other end of the diaphragm 306 in the thickness direction, a diaphragm lower-side supporting member (holding member) 308 is disposed to securely support the diaphragm 306 along with the diaphragm upper-side supporting member (hereinafter referred to as the upper-side supporting member) 307. The diaphragm lower-side supporting member (hereinafter referred to as the lower-side supporting member) 308 has a recess portion (holding member deformed portion) 308*a* at a position corresponding to a deformation facilitating portion (moving member deformed portion) 306*a* formed in the diaphragm 306. The recess portion 308*a* has a shape corresponding to the deformation facilitating portion 306*a* as shown in FIGS. 4, 5.

The deformation facilitating portion 306*a* is formed by deforming a part of the diaphragm 306 at an external side in a diameter direction into a wave shape so that the diaphragm 306 is displaced and deformed substantially in proportion to the pressure difference between the inside and outside pressures of the closed space 305. Further, the lower-side supporting portion 308 has a lower-side flat portion (holding member flat portion) 308*b* on a surface facing the diaphragm 306. When the valve orifice 303 is closed by the valve 304, the lower-side flat portion 308*b* is disposed substantially on the same surface of a contact surface 304*a* of the valve 304 for making contact with the diaphragm 306.

Figure 3:
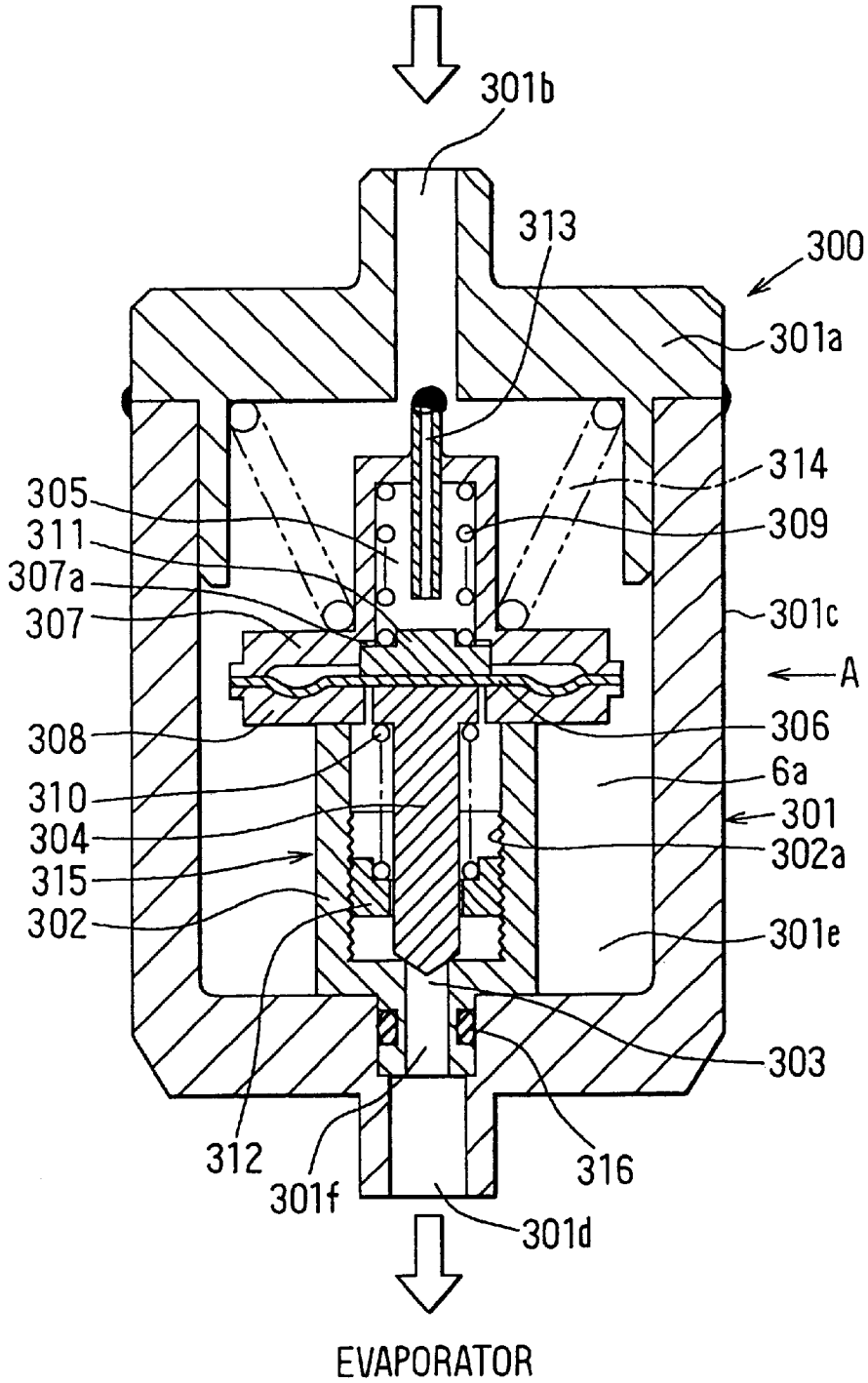
FIG. 3 is a cross-sectional view showing a pressure control valve according to the first embodiment of the present invention.

Furthermore, as shown in FIG. 3, a first coil spring (first elastic member) 309 is disposed on the side of the one end of the diaphragm 306 in the thickness direction (inside the closed space 305). The first coil spring 309 applies elastic force to the valve 304 through the diaphragm 306 so that the valve orifice 303 is closed. On the side of the other end of the diaphragm 306 in the thickness direction, a second coil spring (second elastic member) 310 is disposed. The second coil spring 310 applies elastic force to the valve 304 so that the valve orifice 303 is opened.

A plate (rigid body) 311 is formed of metal and has a preset thickness so that the plate 311 has a rigidity larger than that of the diaphragm 306. The plate 311 functions as a spring seat for the first coil spring 309. As shown in FIGS. 4, 5, the plate 311 makes contact with a step portion (stopper portion) 307*a* formed in the upper-side supporting member 307, thereby restricting the diaphragm 306 from being displaced more than a preset amount toward the one end of the diaphragm 306 in the thickness direction (toward the closed space 305).

The upper-side supporting member 307 has an upper-side flat portion (forming member flat portion) 307*b*. When the plate 311 makes contact with the step portion 307*a*, the upper-side flat portion 308*b* is disposed substantially on the same surface of a contact surface 311*a* of the plate 311 for making contact with the diaphragm 306. An inner wall of a cylindrical portion 307*c* of the upper-side supporting member 307 functions as a guiding portion for the first coil spring 309.

The plate 311 and the valve 304 are pressed against the diaphragm 306 by the first and second coil springs 309, 310, respectively; therefore, the plate 311 and the valve 304 integrally move (operate) while making contact with each other.

Referring to FIG. 3, an adjustment screw (elastic force adjustment mechanism) 312 adjusts elastic force applied to the valve 304 by the second coil spring 310 and functions as a plate for the second coil spring 310. The adjustment screw 312 is connected with a female screw 302*a* formed on the partition member 302. An initial load (elastic force when the valve orifice 303 is closed) of the first and second coil springs 309, 310 is approximately 1 MPa when converted to pressure applied to the diaphragm 306.

A filling tube (piercing member) 313 is disposed to pierce the upper-side supporting member 307, while protruding both the inside and the outside of the closed space 305. $CO_2$ is filled into the closed space 305 through the filling tube 313. The filling tube 313 is made of a material having a heat conductivity larger than that of the upper-side supporting member 307 made of stainless steel, such as copper. After $CO_2$ is filled into the closed space 305 with a density of approximately 600 kg/m$^3$ while the valve orifice 303 is closed, an end of the filling tube 313 is blocked by welding or like.

Figure 6A:
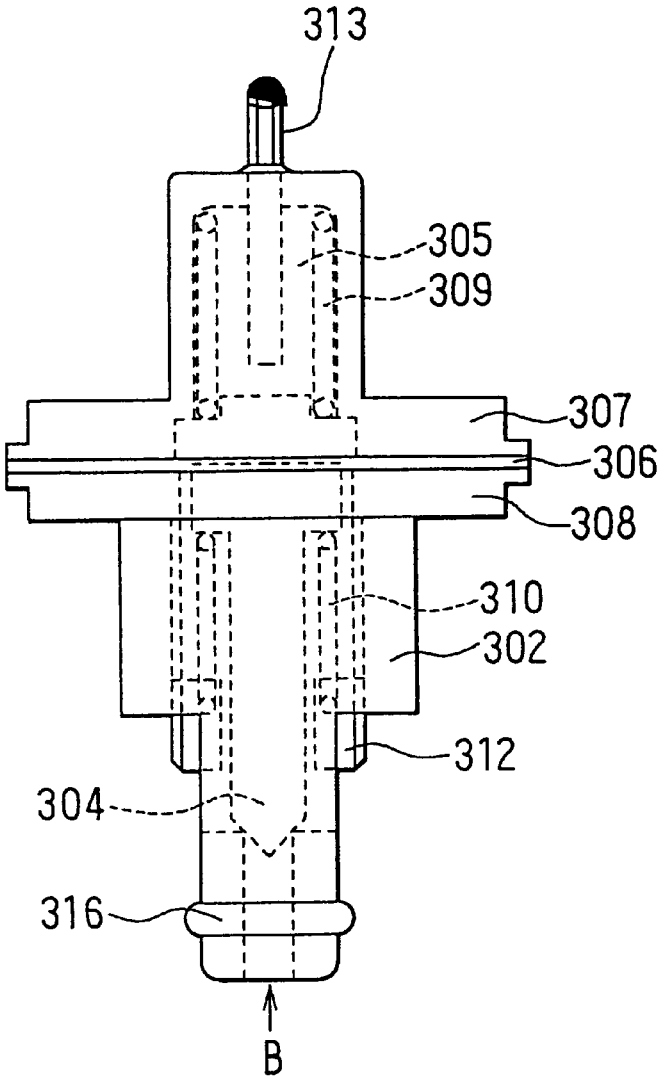
FIG. 6A is a schematic side view taken from an arrow A in FIG. 3 according to the first embodiment of the present invention.
Figure 6B:
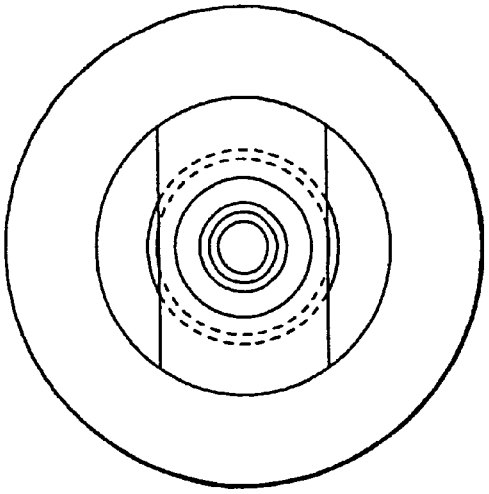
FIG. 6B is a schematic bottom plan view taken from an arrow B in FIG. 6A according to the first embodiment of the present invention.

The element case 315 consisting of the parts 302–313 is secured inside the casing main portion 301*c* by using a conical spring 314. An O-ring 316 seals an opening between the element case 315 (partition wall 302) and the casing main portion 301*c*. FIG. 6A is a schematic view taken from an arrow A in FIG. 3, showing the element case 315. The valve orifice 303 communicates with the upstream side space 301*e* at a side of the outer surface of the partition member 302.

The operation of the pressure control valve 300 according to the first embodiment of the present invention will be described as follows.

Figure 7:
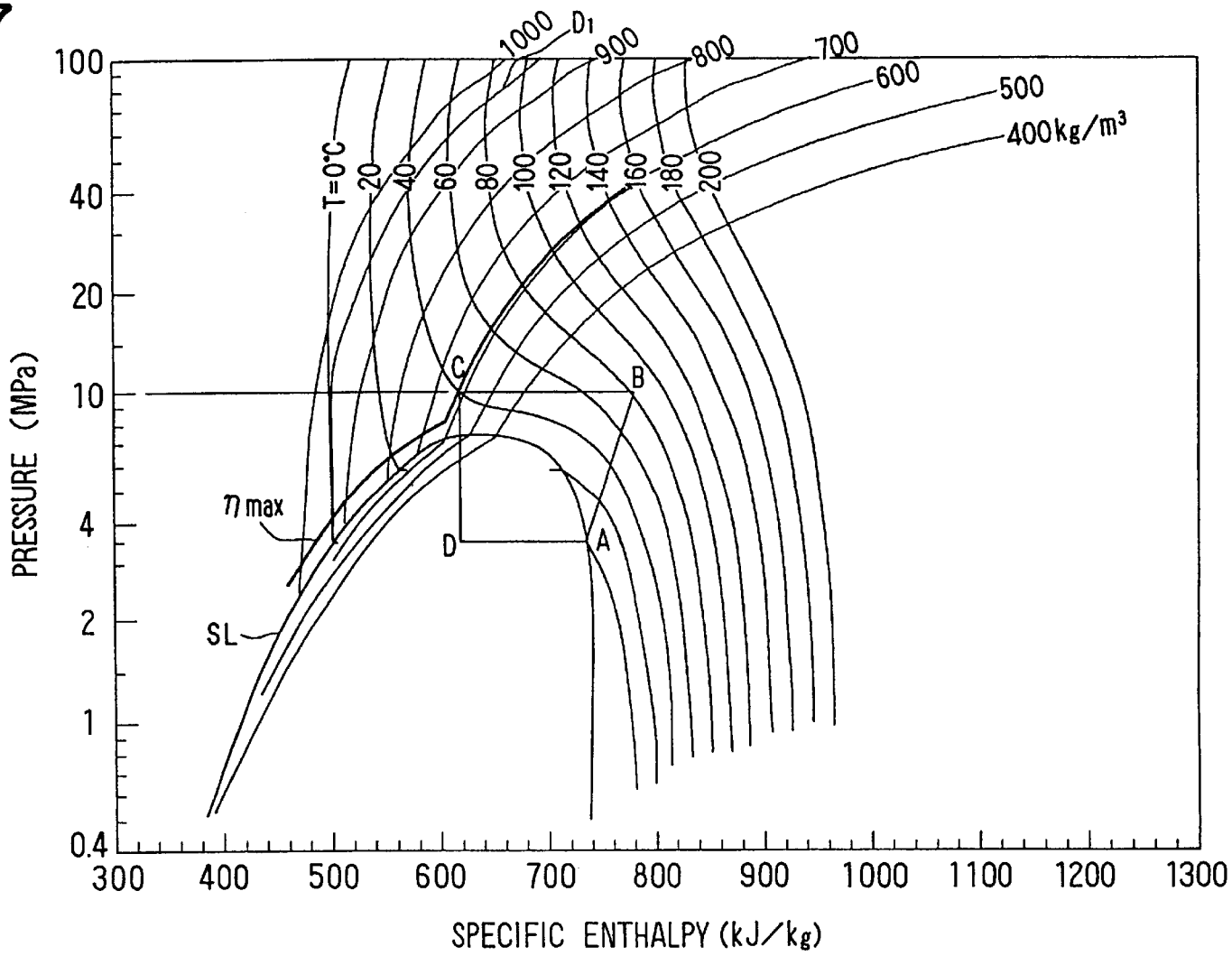
FIG. 7 is a Mollier diagram of $CO_2$ according to the first embodiment of the present invention.
Figure 8:
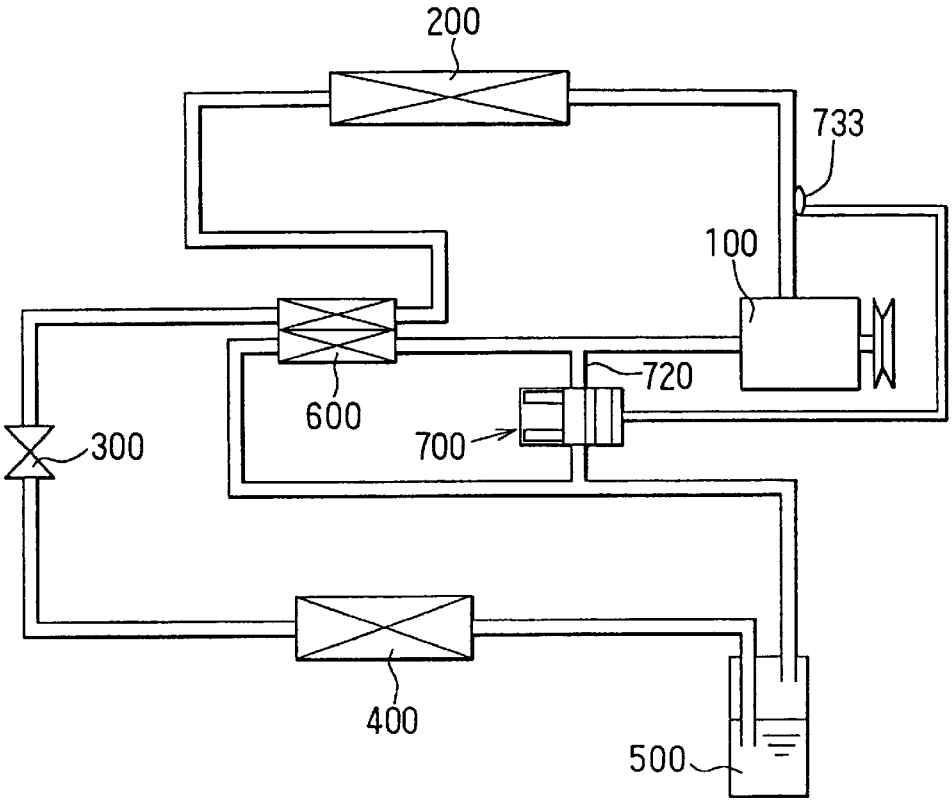
FIG. 8 is a schematic view showing a supercritical refrigerating cycle according to a second embodiment of the present invention.

$CO_2$ is filled in the closed space 305 with a density of approximately 600 kg/m$^3$; therefore, a pressure and a temperature inside the closed space 305 change along an isopycnic line of 600 kg/m$^3$ shown in FIG. 7. For example, when the temperature inside the closed space 305 is 20° C., the pressure inside the closed space 305 is approximately 5.8 MPa. Since both the inside pressure of the closed space 305 and the initial load of the first and second coil springs 309, 310 are applied to the valve 304 simultaneously, an operation pressure applied to the valve 304 is approximately 6.8 MPa.

Therefore, when the pressure inside the upstream side space 301*e* on a side of the gas cooler 2 is 6.8 MPa or lower, the valve orifice 303 is closed by the valve 304. When the pressure inside the upstream side space 301*e* exceeds 6.8 MPa, the valve orifice 303 is opened.

When the temperature inside the closed space 305 is 40° C., for example, the pressure inside the closed space 305 is approximately 9.7 MPa according to FIG. 7, and operation force applied to the valve 304 is approximately 10.7 MPa. Therefore, when the pressure inside the upstream side space 301*e* is 10.7 MPa or lower, the valve orifice 303 is closed by the valve 304. When the pressure inside the upstream side space 301*e* exceeds 10.7 MPa, the valve orifice 303 is opened.

The operation of the $CO_2$ cycle will be described with reference to FIG. 7.

When the temperature on the outlet side of the gas cooler 200 is 40° C. and the pressure on the outlet side of the gas cooler 200 is 10.7 MPa or less, the pressure control valve 300 is closed as described above. Therefore, the compressor 100 sucks $CO_2$ stored in the accumulator 500 and discharges $CO_2$ toward the gas cooler 200, thereby increasing the pressure on the outlet side of the gas cooler 200.

When the pressure on the outlet side of the gas cooler 200 exceeds 10.7 MPa (B-C), the pressure control valve 300 opens. As a result, $CO_2$ is decompressed to perform phase transition from gas phase to gas-liquid two-phase (C-D), and flows into the evaporator 400. The gas-liquid two-phase $CO_2$ is evaporated inside the evaporator 400 (D-A) to cool air, and returns to the accumulator 500. Meanwhile, the pressure on the outlet side of the gas cooler 200 decreases again, resulting in that the pressure control valve 300 is closed again.

That is, in this $CO_2$ cycle, after the pressure on the outlet side of the gas cooler 200 is increased to a preset pressure by closing the pressure control valve 300, $CO_2$ is decompressed and evaporated so that air is cooled.

According to the $CO_2$ cycle of the first embodiment has the refrigerant bypass means 700. Therefore, when the temperature of $CO_2$ on the discharge side of the compressor 100 (the inlet side of the gas cooler 200) exceeds the preset temperature T, $CO_2$ discharged from the accumulator 500 flows through the refrigerant bypass means 700 to bypass the internal heat exchanger 600, thereby decreasing the heating degree of $CO_2$ on the suction side of the compressor 100 (low-pressure $CO_2$) to 0° C. Thus, the temperature of the low-pressure $CO_2$ becomes lower than that of $CO_2$ sucked into the compressor 100 via the internal heat exchanger 600. Accordingly, the temperature of $CO_2$ in the $CO_2$ passage extending from the suction side to discharge side of the compressor 100 decreases, thereby preventing breakage of the compressor 100.

Furthermore, the $CO_2$ cycle also has the accumulator 500, thereby restricting liquid phase $CO_2$ from being sucked into the compressor 100. This prevents the compressor 100 from being damaged due to liquid compression.

Second Embodiment

In the above-mentioned first embodiment, the refrigerant bypass means 700 consists of electrical units such as the electromagnetic valve 710 and the temperature sensor 730. However, in a second embodiment of the present invention, the refrigerant bypass means 700 is constituted mechanically.

In this and subsequent embodiment, components which are substantially the same to those in the first embodiment are assigned the same reference numerals.

Figure 9:
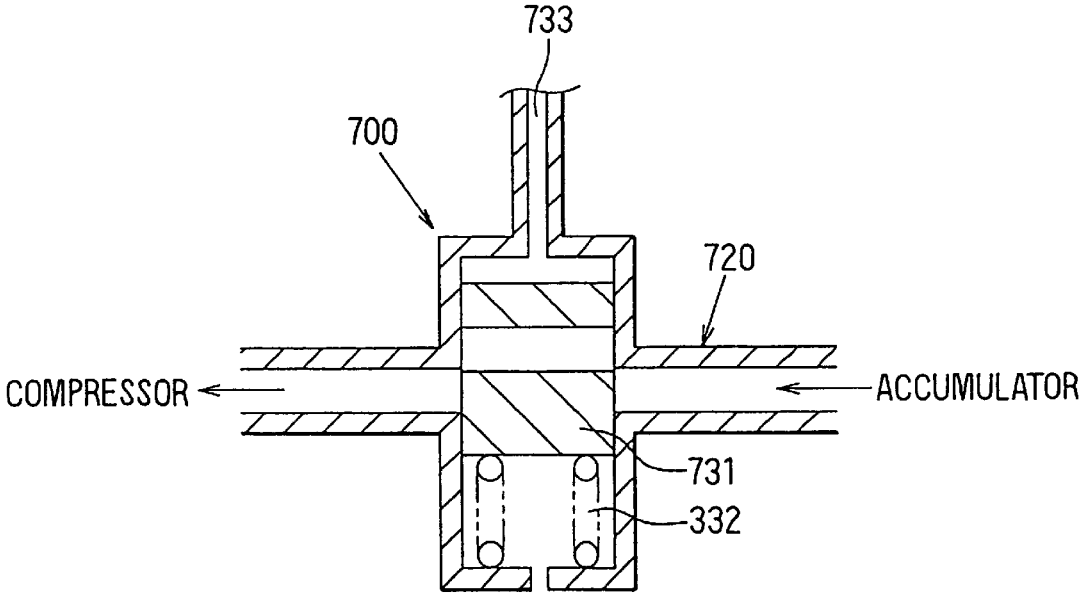
FIG. 9 is a schematic sectional view showing a pressure control valve according to the second embodiment of the present invention.

As shown in FIG. 9, a spring (elastic body) 332 is disposed on one side of a valve 731 which opens and closes the bypass passage 720. The spring 332 applies elastic force to a valve 731 so that the bypass passage 720 is closed. A temperature detecting cylindrical portion 733 is disposed on the other side of the valve 731 to apply pressure to the valve 731 so that the bypass passage 720 is opened. The temperature detecting cylindrical portion 733 is filled with fluid such as isobutane at a preset density.

Therefore, when a pressure inside the temperature detecting cylindrical portion 733 increases as the temperature of $CO_2$ on the discharge side of the compressor 100 increases, the valve 731 operates to open the bypass passage 720 due to the pressure increase. On the other hand, when the pressure inside the temperature detecting cylindrical portion 733 decreases as the temperature of $CO_2$ on the discharge side of the compressor 100 decreases, the bypass passage 720 is closed due to elastic force of the spring 332.

Third Embodiment

In the above-mentioned first and second embodiments, the temperature of $CO_2$ is detected electronically or mechanically so that the bypass passage is opened and closed.

However, in a third embodiment of the present invention, it is focused that the pressure of the low-pressure $CO_2$ changes as the temperature of the low-pressure $CO_2$ (temperature of $CO_2$ on the discharge side of the compressor 100) changes.

Figure 10:
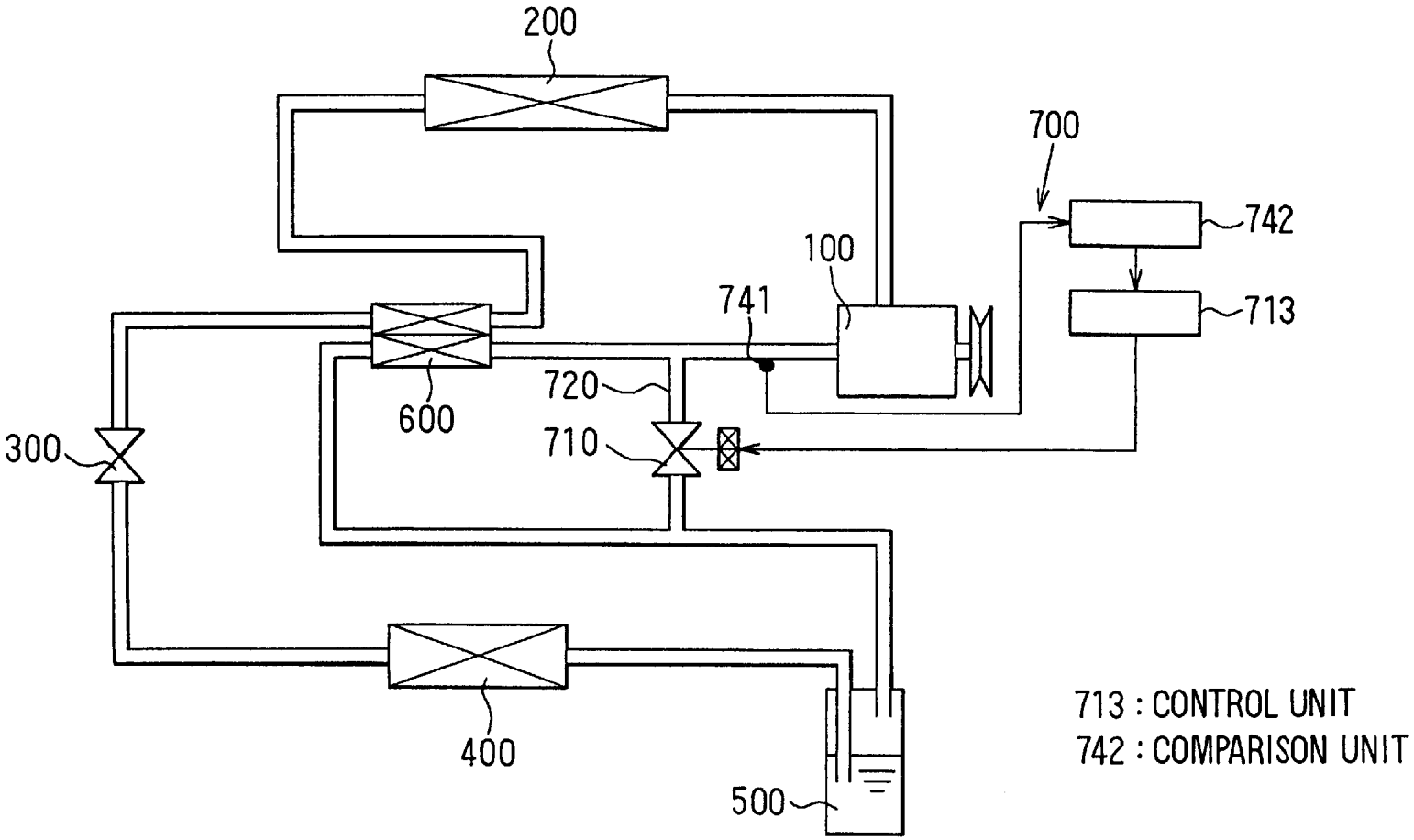
FIG. 10 is a schematic view showing a supercritical refrigerating cycle according to a third embodiment of the present invention.

As shown in FIG. 10, in the third embodiment, a pressure sensor (pressure detecting means) 741 for detecting a pressure of the low-pressure $CO_2$ and a comparison unit 742 are disposed between the outlet side of the evaporator 400 and the suction side of the compressor 100. The comparison unit 742 sends a signal to the control unit 713 when a pressure detected by the pressure sensor 741 is equal to or lower than a preset pressure P. The preset pressure P corresponds to the preset temperature T in the first and second embodiments, and is approximately 6 MPa in the third embodiment.

Therefore, when the pressure of the low-pressure $CO_2$ becomes equal to or lower than the preset pressure P, $CO_2$ discharged from the accumulator 500 bypasses the internal heat exchanger 600 same as in the first and second embodiments, thereby decreasing the heating degree of $CO_2$ on the suction side of the compressor 100 (low-pressure $CO_2$) to 0° C. As a result, the temperature of the low-pressure $CO_2$ becomes lower than that of $CO_2$ sucked to the compressor 100 via the internal heat exchanger 600. Accordingly, the temperature of $CO_2$ in the $CO_2$ passage extending from the suction side to the discharge side of the compressor 100 is decreased, thereby preventing breakage of the compressor 100.

(FOURTH EMBODIMENT)

Figure 11:
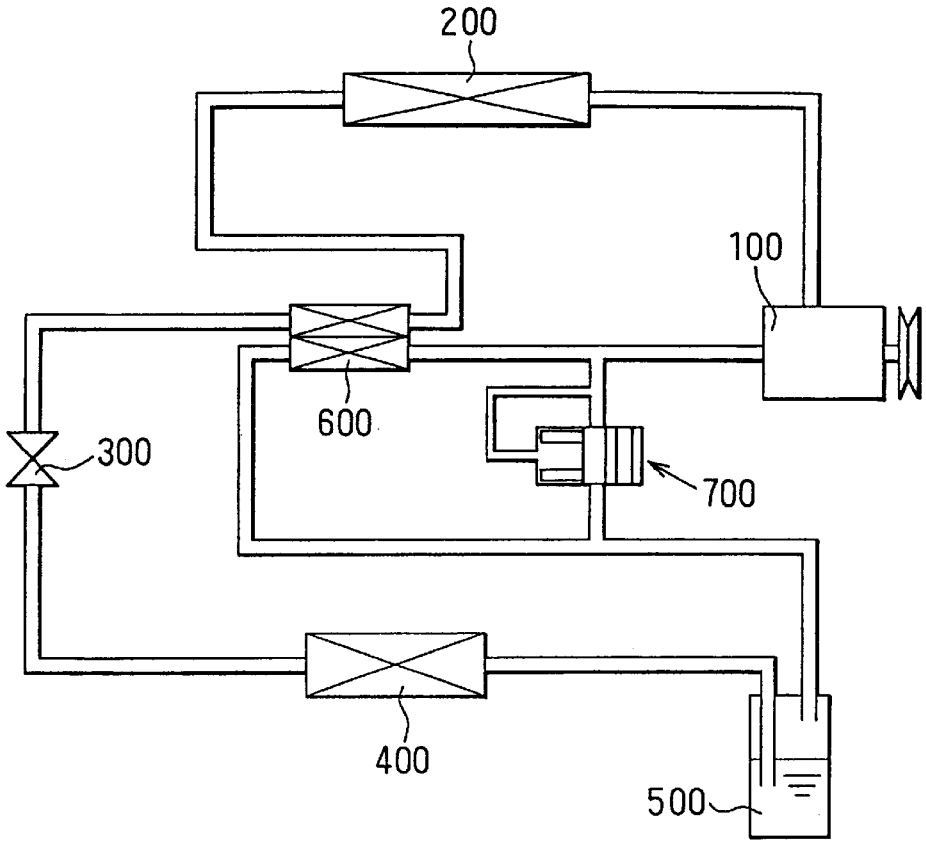
FIG. 11 is a schematic view showing the supercritical refrigerating cycle according to a fourth embodiment of the present invention.

In the third embodiment, the refrigerant bypass means 700 has the pressure sensor 741 for electrically detecting the pressure on the suction side of the compressor 100. In a forth embodiment of the present invention, as shown in FIGS. 11, 12, the refrigerant bypass means 700 is mechanically operated according to the pressure on the suction side of the compressor 100.

Figure 12:
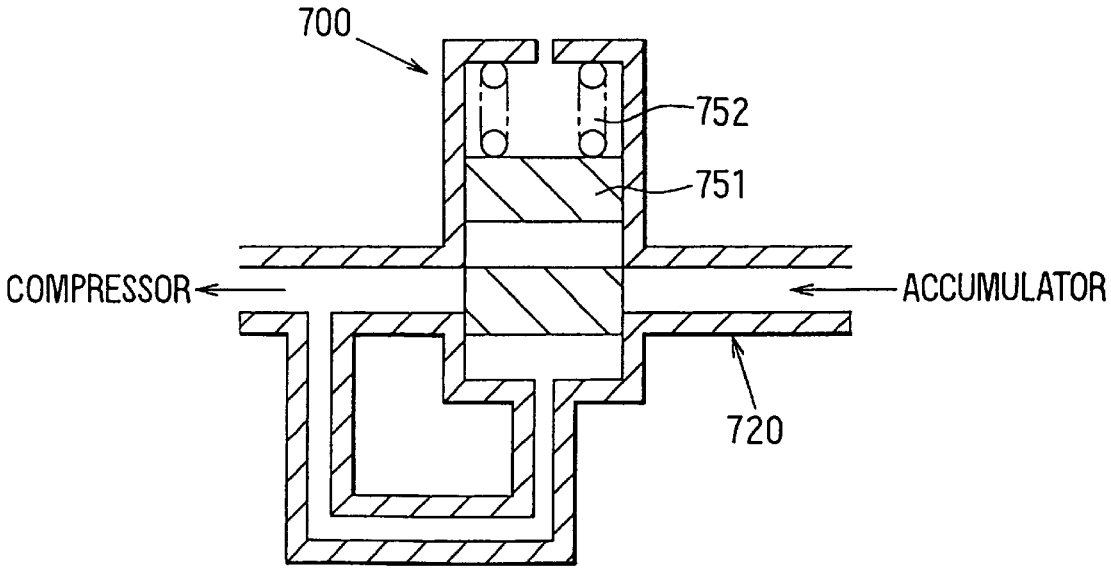
FIG. 12 is a schematic sectional view showing a pressure control valve according to the fourth embodiment of the present invention.

As shown in FIG. 12, a spring (elastic body) 752 is disposed on one side of a valve 751 which opens and closes the bypass passage 720. The spring 752 applies elastic force to the valve 751 so that the bypass passage 720 is opened.

The pressure on the suction side of the compressor 100 is introduced to the other side of the valve 751, thereby applying force to the valve 751 so that the bypass passage 720 is closed.

Therefore, when the pressure on the suction side of the compressor 100 decreases as the heat load decreases, the valve 751 is displaced due to elastic force of the spring 752 so that the bypass passage 720 is opened. When the pressure on the suction side of the compressor 100 increases, the bypass passage 720 is closed due to the increased pressure.

The present invention is not limited to the supercritical refrigerating cycle using $CO_2$, but can be applied to a vapor compression refrigerating cycle using various refrigerant used in a supercritical area, such as ethylene, ethane and nitrogen.

Further, in the embodiments of the present invention, the pressure control valve 300 (expansion valve) is constituted mechanically; however, the pressure control valve may be constituted electrically using a pressure sensor and an electrical opening/closing valve, for example.

Figure 13A:
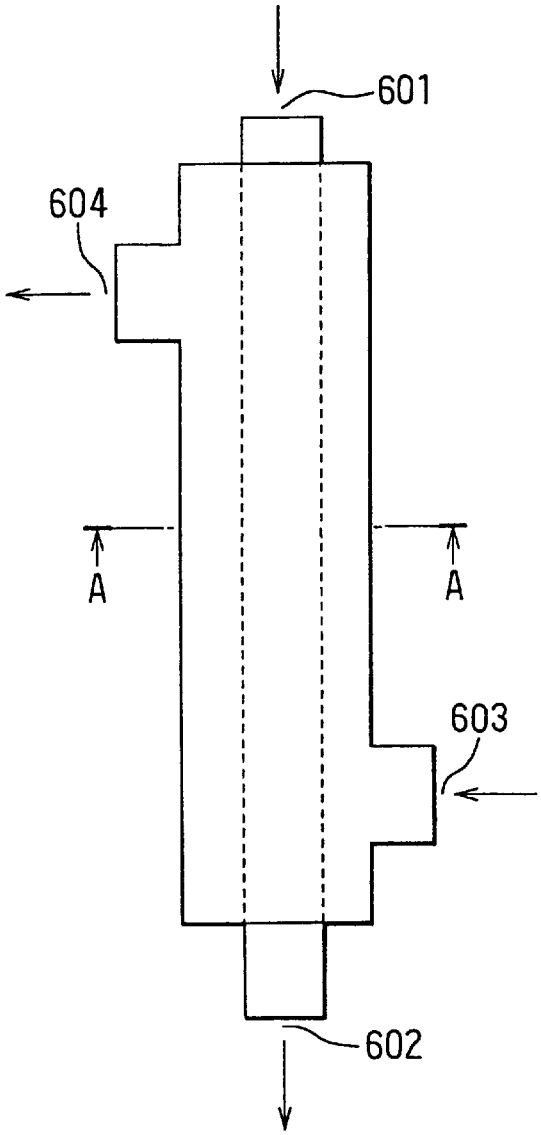
FIG. 13A is a schematic view showing an internal heat exchanger according to a modification of the embodiments of the present invention.
Figure 13B:
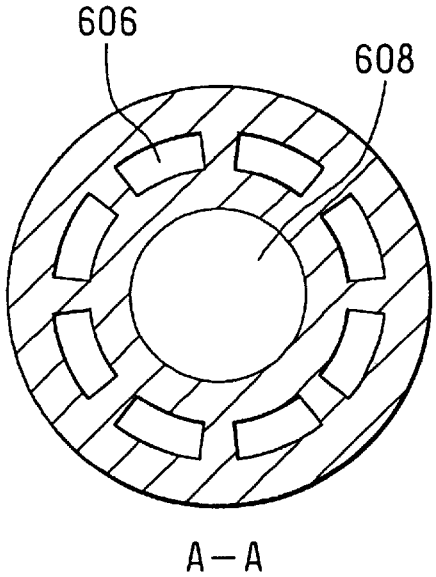
FIG. 13B is a sectional view taken along a line A—A in FIG. 13A according to the modification of the embodiments of the present invention.

Furthermore, the internal heat exchanger 600 is not limited to the spiral structure as shown in FIG. 2, but may have a double cylindrical structure as shown in FIGS. 13A and 13B. In FIG. 13B, the reference numeral 606 represents a low-pressure $CO_2$ passage, and the reference numeral 608 represents a high-pressure $CO_2$ passage.

Further, in the first and second embodiments, valve means such as the electromagnetic valve are opened and closed according to the temperature of $CO_2$ on the discharge side of the compressor 100. However, the detecting point of the temperature of $CO_2$ is not limited to the discharge side of the compressor 100, but may be set to any point in the refrigerant passage extending from the inlet side of the evaporator 400 to the inlet side of the gas cooler 200. However, the preset temperature needs to be suitably set according to each detection point of the temperature.

Fifth Embodiment

Figure 14:
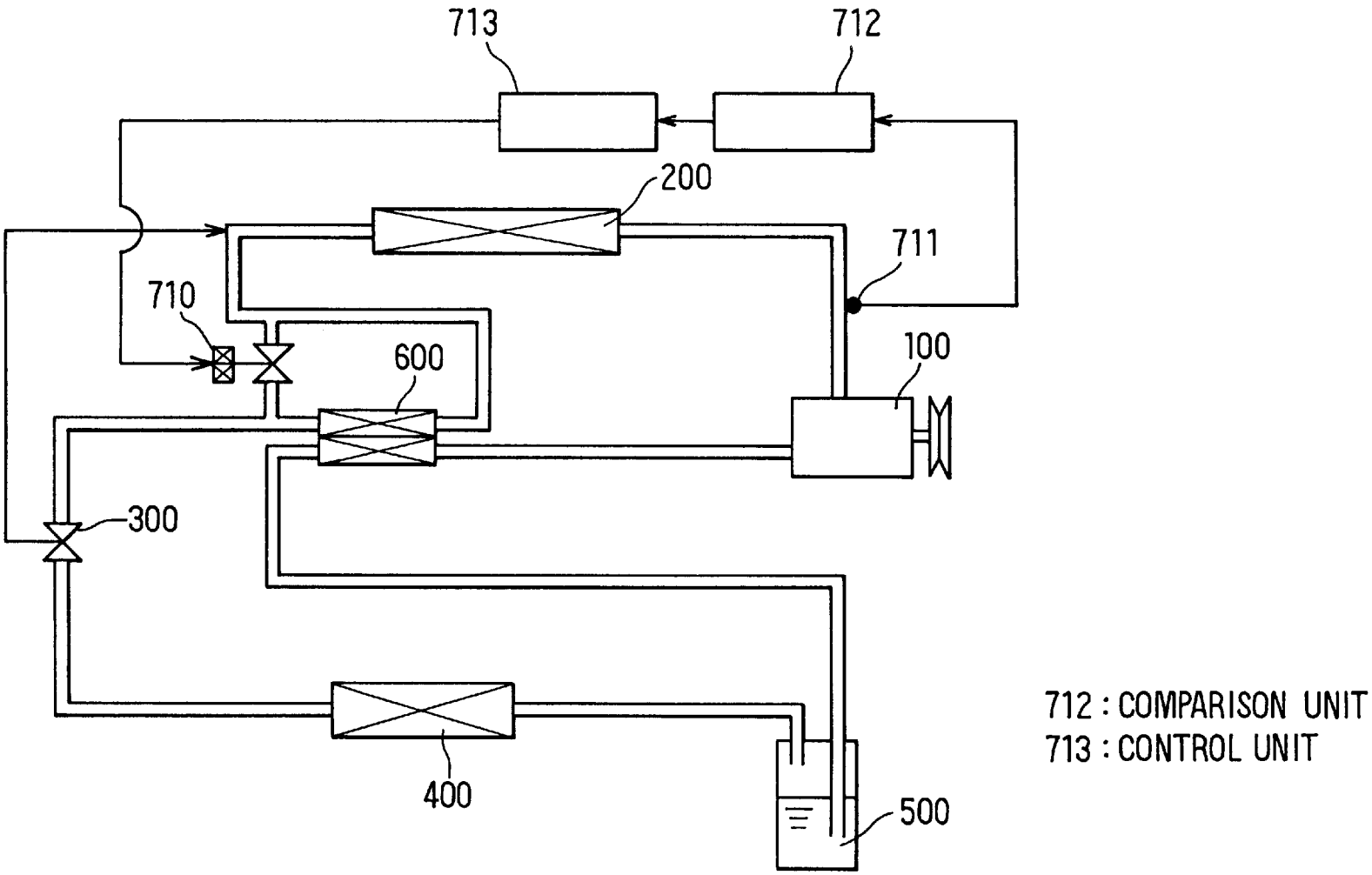
FIG. 14 is a schematic view showing a supercritical refrigerating cycle according to a fifth embodiment of the present invention.

A fifth embodiment of the present invention is shown in FIG. 14. Although the low-pressure passage is bypassed by the bypass passage 720 in the first embodiment, the high-pressure passage is bypassed in the fifth embodiment instead. Therefore, the damage of compressor 100 is prevented by opening the electromagnetic valve and bypassing the internal heat exchanger 600 when the detected temperature is beyond the preset temperature (for example, 120° C.).

Sixth Embodiment

Figure 15:
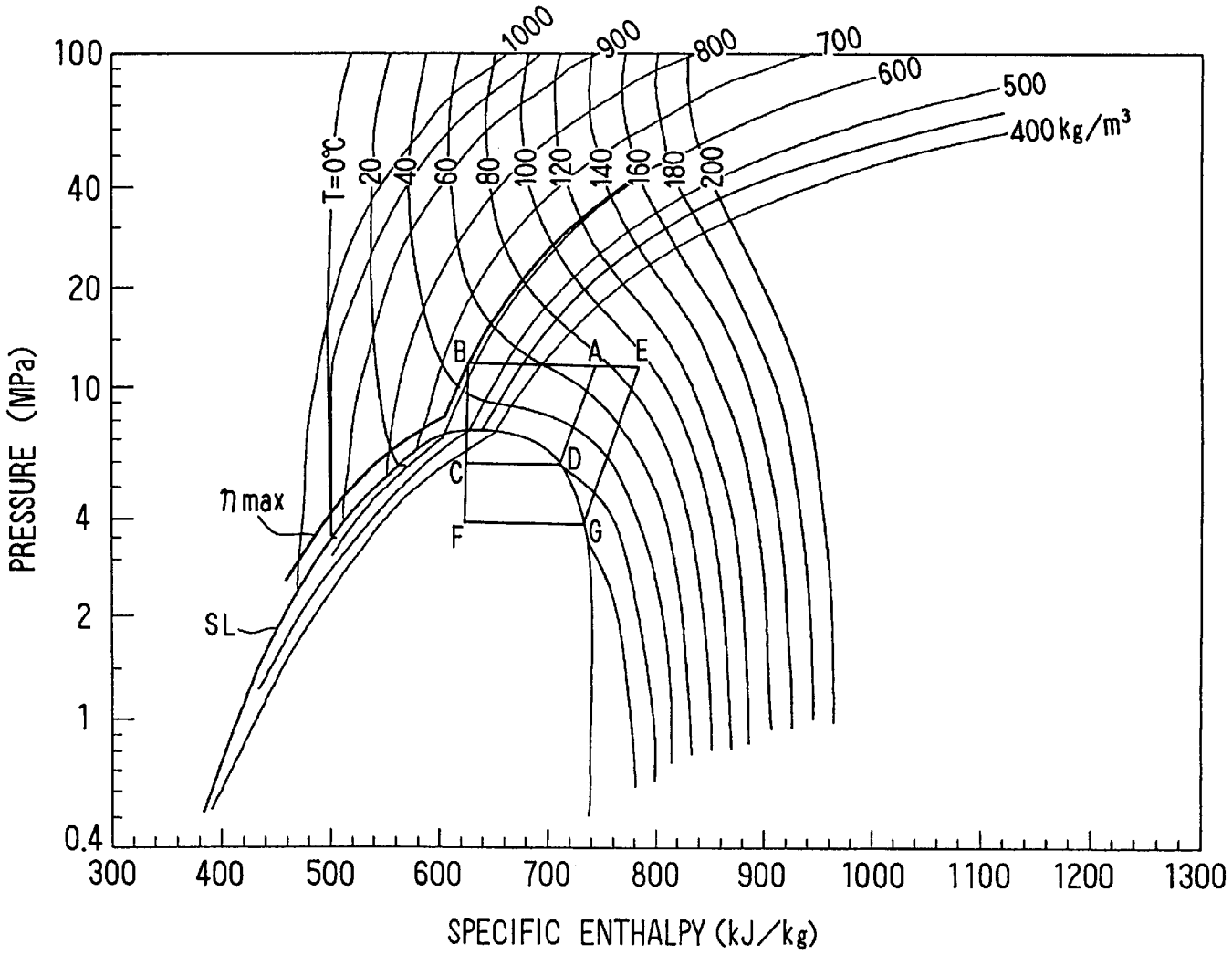
FIG. 15 is a Mollier diagram of $CO_2$ to explain sixth and seventh embodiments of the present invention.
Figure 16:
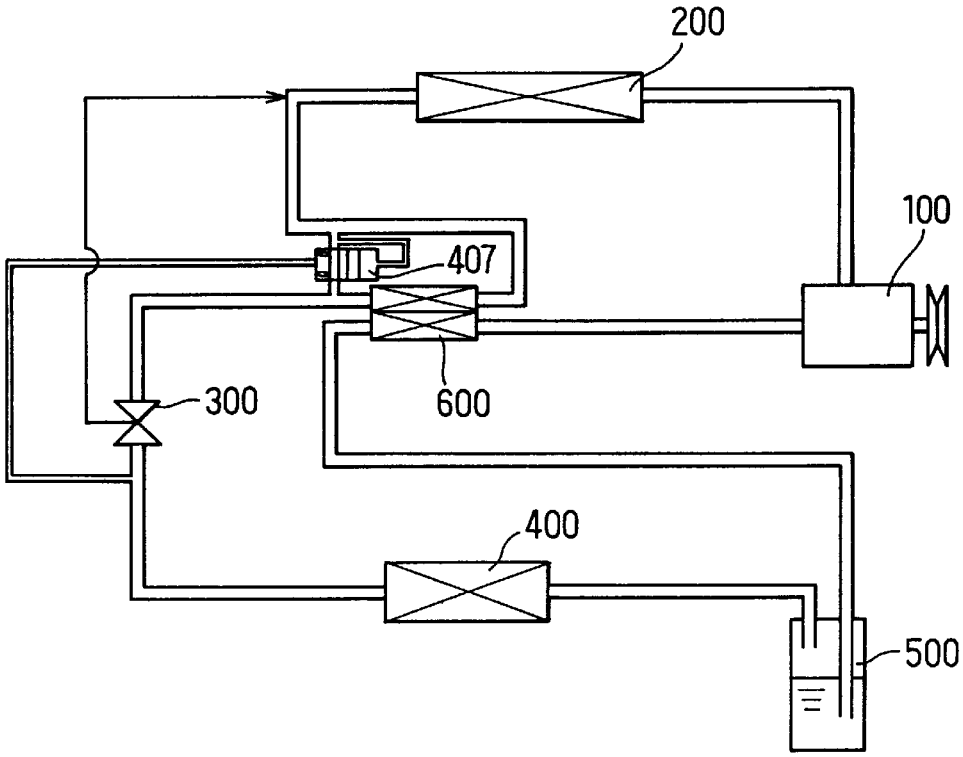
FIG. 16 is a schematic view showing a supercritical refrigerating cycle according to a sixth embodiment of the present invention.
Figure 17:
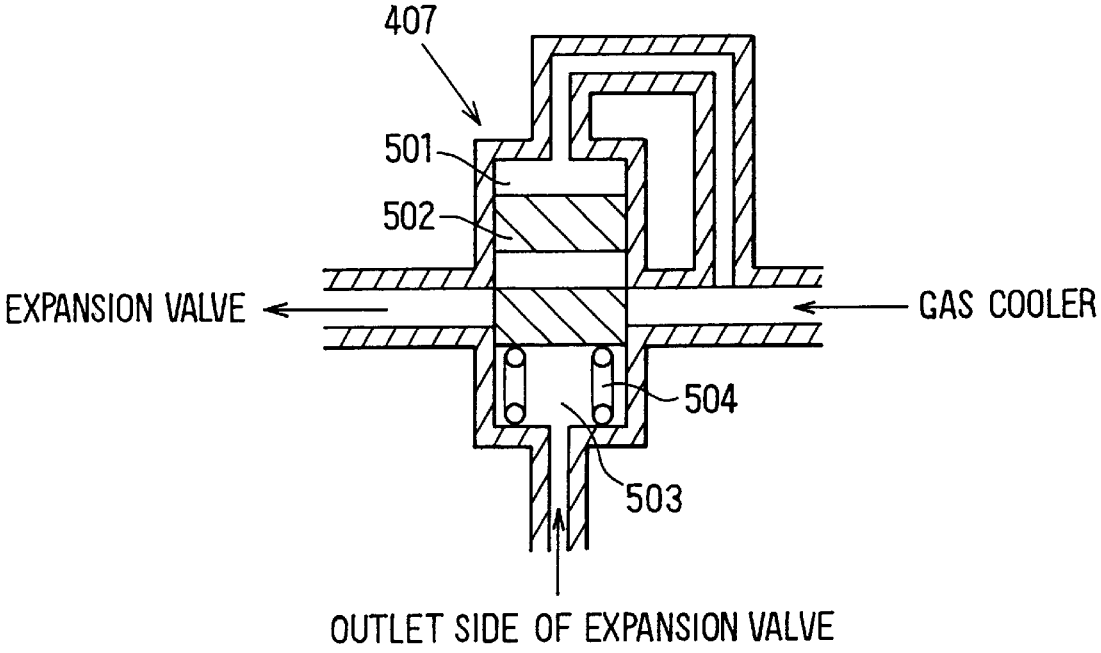
FIG. 17 is a schematic sectional view showing a pressure control valve according to the sixth embodiment of the present invention.

A sixth embodiment of the present invention is shown in FIGS. 15, 16 and 17. The feature of the sixth embodiment is a differential pressure regulating valve 407 which bypasses the high-pressure passage of the internal heat exchanger 600.

Generally, the pressure of the high-pressure $CO_2$ does not change because the external temperature is constant when the cycle is under cooling down. However, there is small pressure difference between high-pressure $CO_2$ and low-pressure $CO_2$ since the pressure of low-pressure $CO_2$ is high immediately after turning on the switch of the refrigerating cycle. Under this circumstance, the passenger compartment should be cooled as soon as possible, and the internal heat exchanger 600 should be used because the discharge temperature is low (A-B-C-D in FIG. 15).

The pressure difference between high-pressure $CO_2$ and low-pressure $CO_2$ becomes large since the pressure of low-pressure $CO_2$ is lowered when the passenger compartment is sufficiently cooled. Under this circumstance, the cooling performance is sufficient and the discharge temperature is high. Therefore, the internal heat exchanger 600 should not be used(E-B-F-G). The sixth and seventh embodiments of the present invention are characterized in taking the pressure difference between high-pressure $CO_2$ and low-pressure $CO_2$ into consideration.

In the sixth embodiment, the differential pressure regulating valve (bypass valve) 407 is closed and the internal heat exchanger 600 is used when the pressure difference between high-pressure $CO_2$ and low-pressure $CO_2$ is small such as A-B-C-D in FIG. 15.

The differential pressure regulating valve (bypass valve) 407 is opened to bypass the internal heat exchanger 600 when the pressure difference between high-pressure $CO_2$ and low-pressure $CO_2$ is large such as E-B-F-G in FIG. 15. Therefore, the raise in the discharge temperature is prevented, and thus, the damage to the compressor 100 is prevented.

The details of the structure of the differential pressure regulating valve 407 is shown in FIG. 17. The pressure of the outlet of the gas cooler 200 (high-pressure) is introduced into an upper chamber 501. The pressure of the outlet of the expansion valve 300 (low-pressure) is introduced into a lower chamber 503. When the low-pressure is lowered and the pressure difference becomes, for example, 6 MPa or greater, a valve 502 is opened against the spring force of a spring 504.

According to the sixth embodiment, the bypass passage is opened to bypass the internal heat exchanger 600 when the pressure difference between high-pressure $CO_2$ and low-pressure $CO_2$ exceeds certain value. Therefore, the damage to the compressor 100 is prevented. High-pressure $CO_2$ and low-pressure $CO_2$ can be any value within the range of the cycle.

Seventh Embodiment

Figure 18:
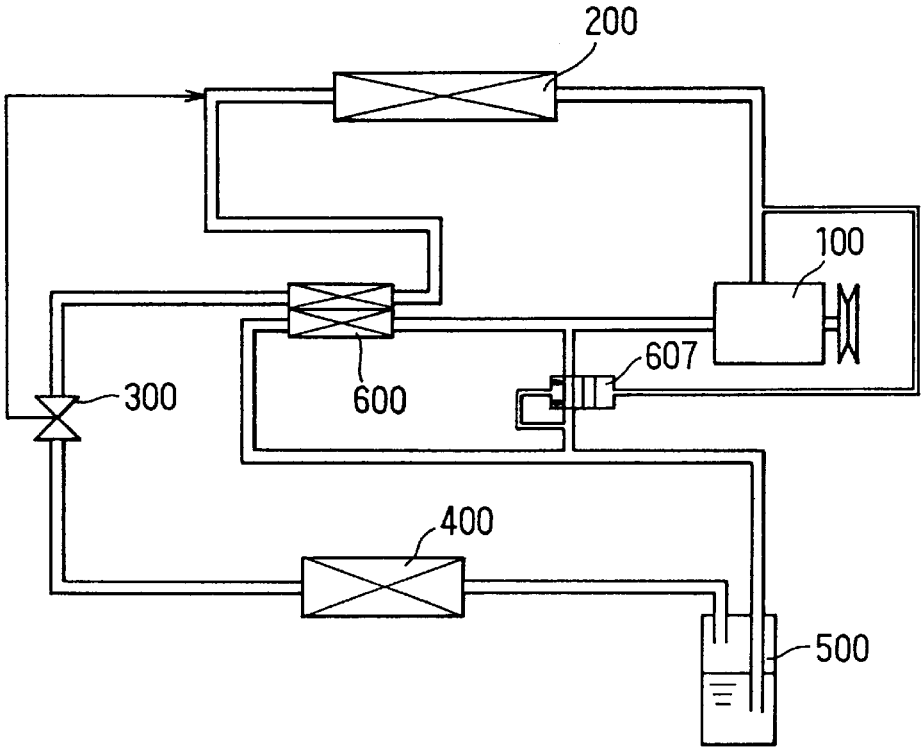
FIG. 18 is a schematic view showing a supercritical refrigerating cycle according to a seventh embodiment of the present invention.
Figure 19:
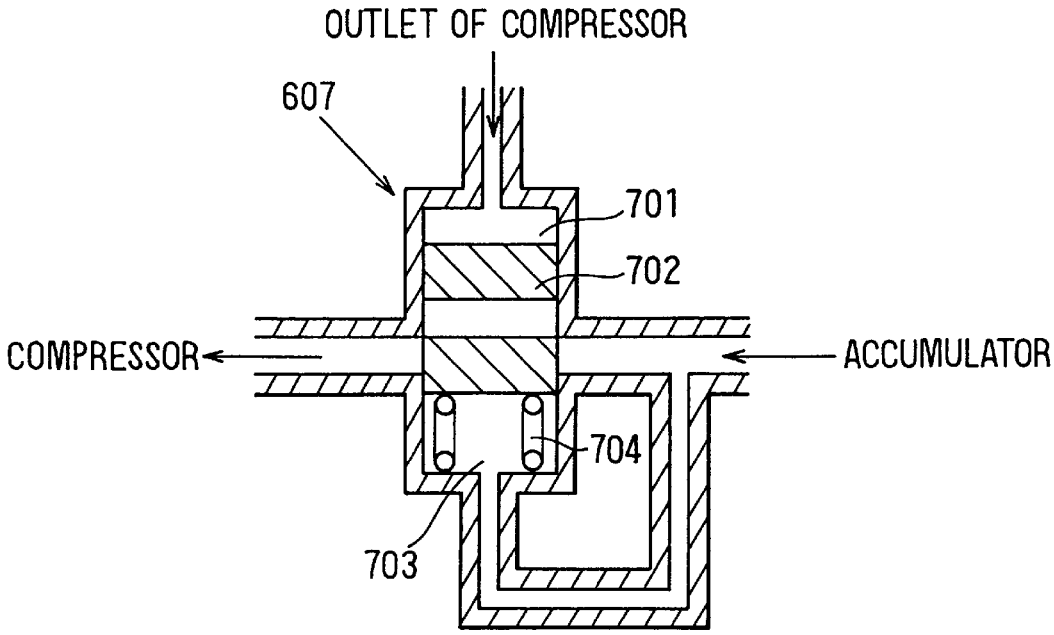
FIG. 19 is a schematic sectional view showing a pressure control valve according to the seventh embodiment of the present invention.

A seventh embodiment of the present invention is shown in FIGS. 15, 18 and 19. The feature of the seventh embodiment is a differential pressure regulating valve 607 which bypasses the low-pressure passage of the internal heat exchanger 600.

In the seventh embodiment, the differential pressure regulating valve (bypass valve) 607 is closed and the internal heat exchanger 600 is used when the pressure difference between high-pressure $CO_2$ and low-pressure $CO_2$ is small such as A-B-C-D in FIG. 15.

The differential pressure regulating valve (bypass valve) 607 is opened to bypass the internal heat exchanger 600 when the pressure difference between high-pressure $CO_2$ and low-pressure $CO_2$ is large such as E-B-F-G in FIG. 15. Therefore, the raise in the discharge temperature is prevented, and thus, the damage to the compressor 100 is prevented.

The details of the structure of the differential pressure regulating valve 607 is shown in FIG. 19. The discharge pressure (high-pressure) is introduced into an upper chamber 701. The pressure of the outlet of the accumulator 500 (low-pressure) is introduced into a lower chamber 703. When the low-pressure is lowered and the pressure difference becomes, for example, 6 MPa or greater, a valve 702 is opened against the spring force of a spring 704.

According to the seventh embodiment, the bypass passage is opened to bypass the internal heat exchanger 600 when the pressure difference between high-pressure $CO_2$ and low-pressure $CO_2$ exceeds certain value. Therefore, the damage to the compressor 100 is prevented. High-pressure $CO_2$ and low-pressure $CO_2$ can be any value within the range of the cycle.

Eighth Embodiment

Figure 20:
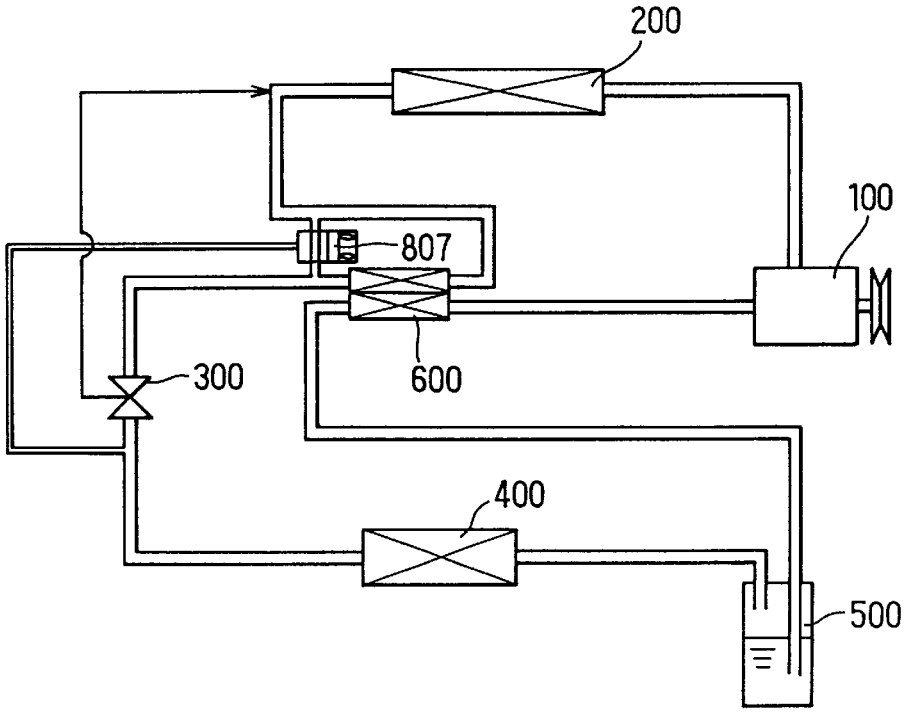
FIG. 20 is a schematic view showing a supercritical refrigerating cycle according to an eighth embodiment of the present invention.
Figure 21:
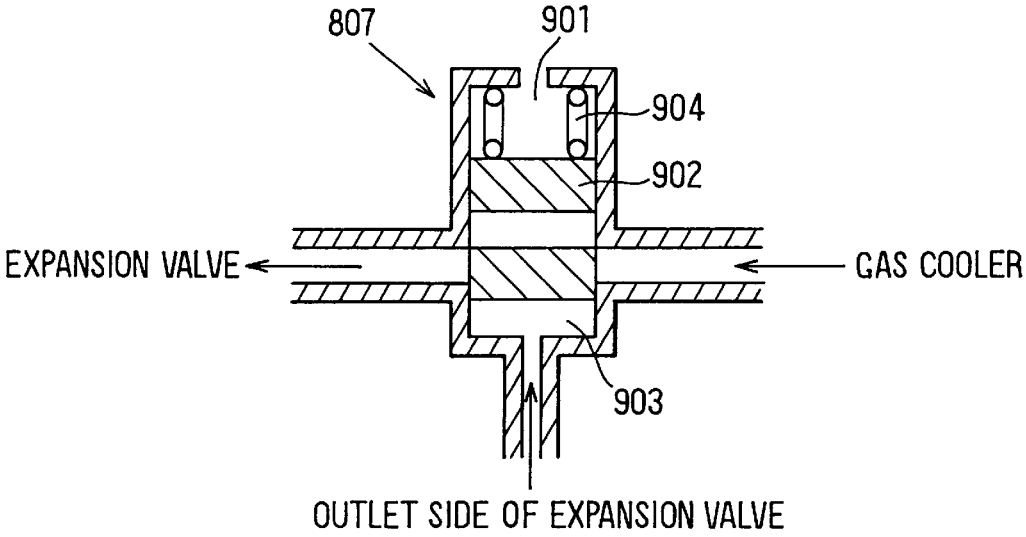
FIG. 21 is a schematic sectional view showing a pressure control valve according to the eighth embodiment of the present invention.

An eighth embodiment of the present invention is shown in FIGS. 20 and 21. As described in the above sixth and seventh embodiment, the pressure of the low-pressure $CO_2$ is high when the internal heat exchanger is necessary such as the initial stage of the cooling down, and it is low when the internal heat exchanger is not necessary such as when the passenger compartment is sufficiently cooled. The eighth and ninth embodiments of the present invention are characterized in taking the low-pressure $CO_2$ into consideration.

In the eighth embodiment, a constant pressure regulating valve (bypass valve) 807 is closed and the internal heat exchanger 600 is used when the low-pressure $CO_2$ is high such as A-B-C-D in FIG. 15.

The constant pressure regulating valve 807 is opened to bypass the internal heat exchanger 600 when the low-pressure $CO_2$ is low such as E-B-F-G in FIG. 15. Therefore, the raise in the discharge temperature is prevented, and thus, the damage to the compressor 100 is prevented.

The details of the structure of the constant pressure regulating valve 807 is shown in FIG. 21. The outlet pressure of the expansion valve 300 (low-pressure) is introduced into a lower chamber 903. When the pressure in the lower chamber 903 becomes, for example, 4 MPa or less, a valve 902 is opened against the spring force of a spring 904.

According to the eighth embodiment, the bypass passage is opened to bypass the internal heat exchanger 600 when the pressure of the low-pressure $CO_2$ is lower than certain value. Therefore, the damage to the compressor 100 is prevented. The low-pressure $CO_2$ can be any value within the range of the cycle.

Ninth Embodiment

Figure 22:
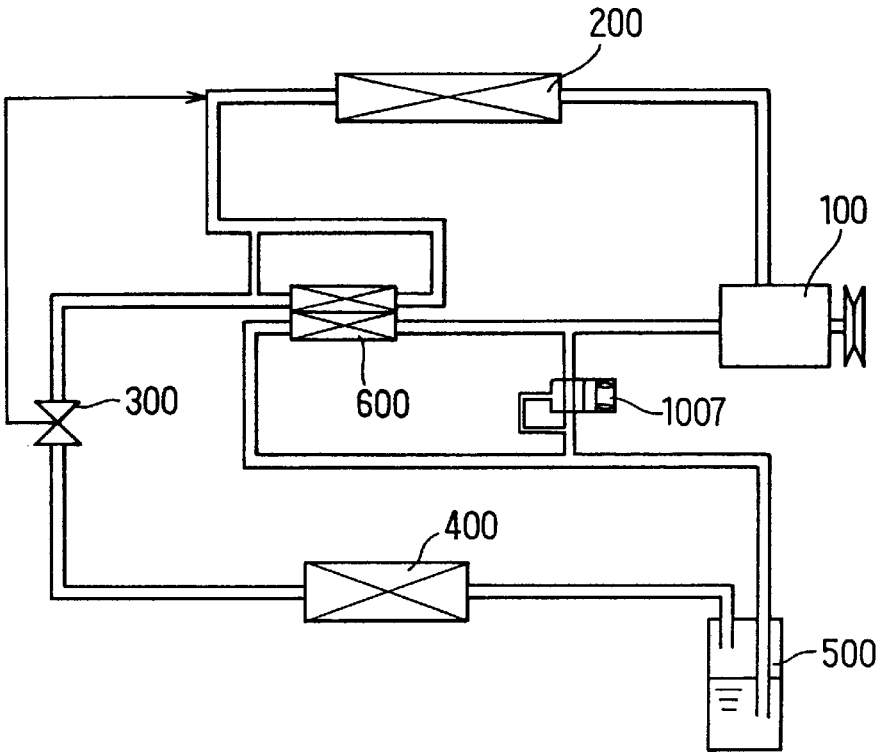
FIG. 22 is a schematic view showing a supercritical refrigerating cycle according to a ninth embodiment of the present invention.
Figure 23:
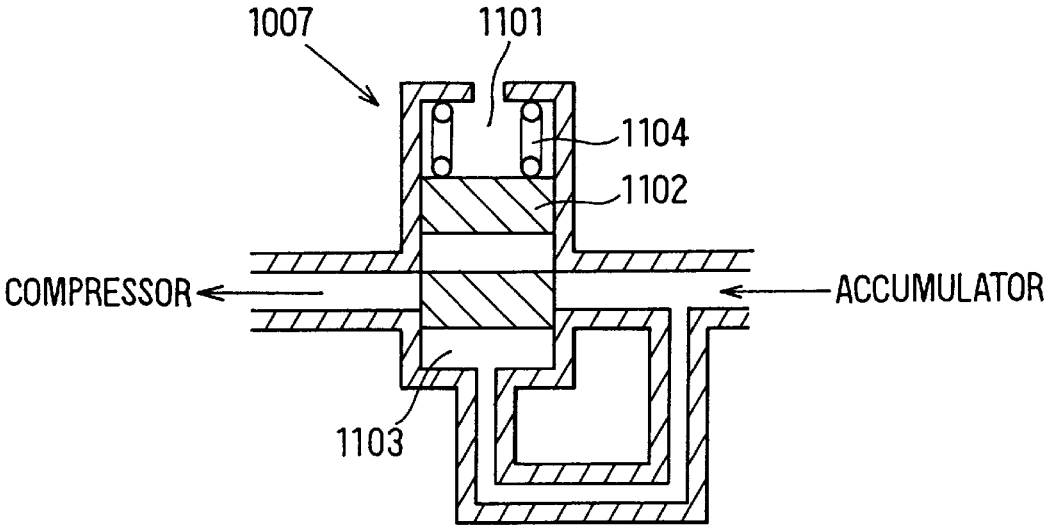
FIG. 23 is a schematic sectional view showing a pressure control valve according to the ninth embodiment of the present invention.
Figure 24:
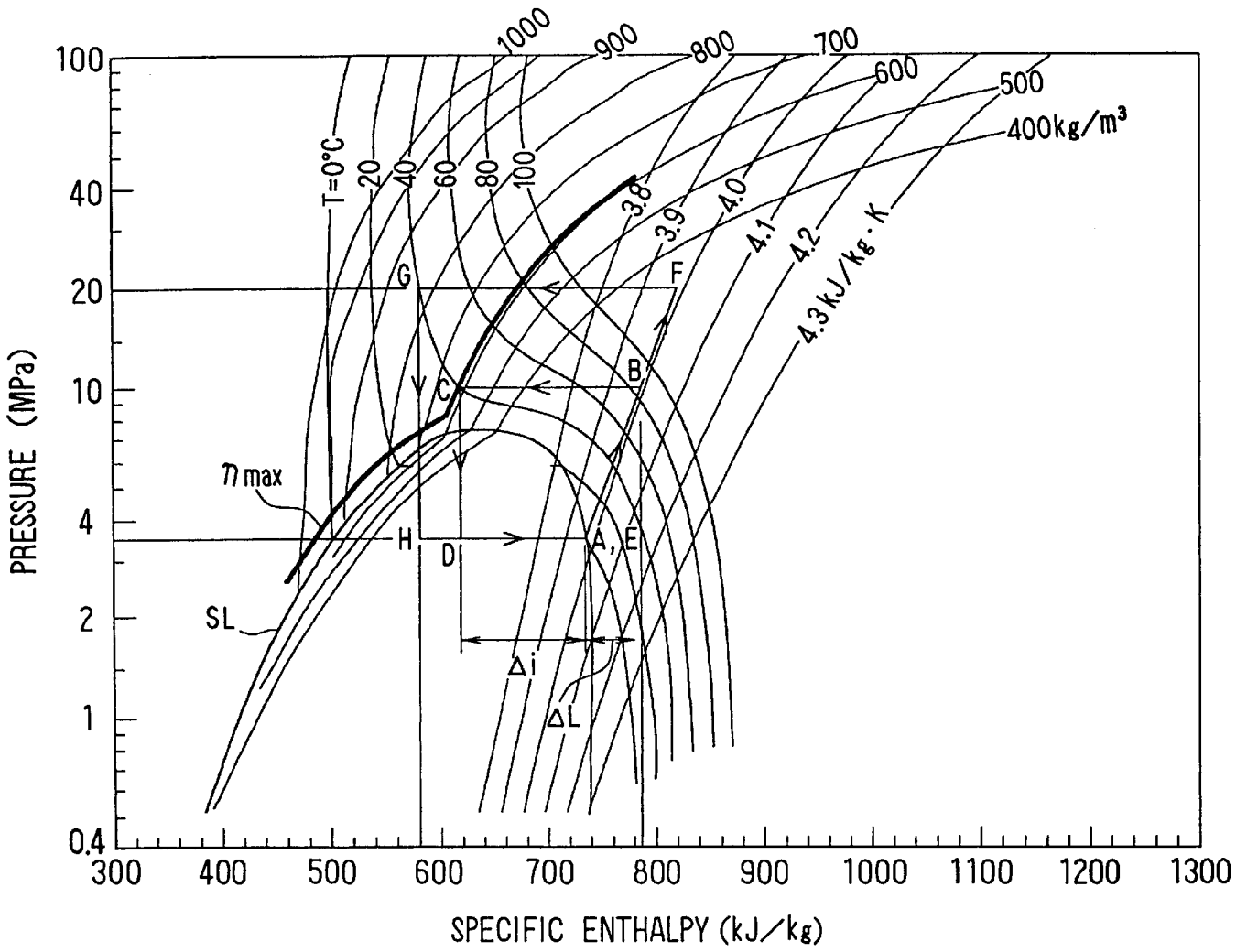
FIG. 24 PRIOR ART
FIG. 24 is a Mollier diagram of $CO_2$ to explain a problem in the prior art.
Figure 25:
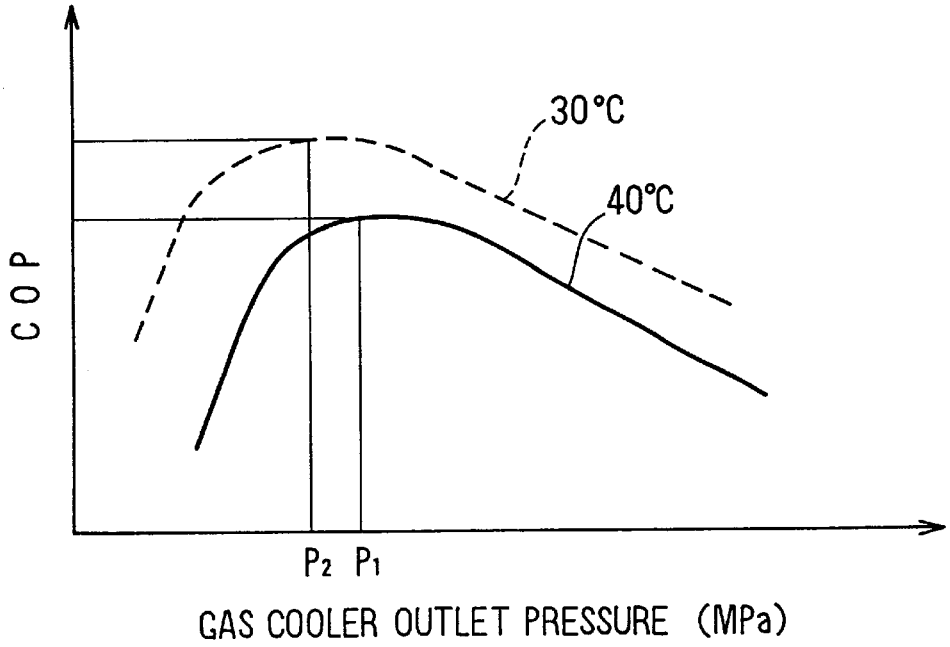
FIG. 25 PRIOR ART
FIG. 25 is a graph showing a relationship between a pressure on an outlet side of a gas cooler and a performance coefficient (COP) to explain the problem in the prior art.
Figure 26:
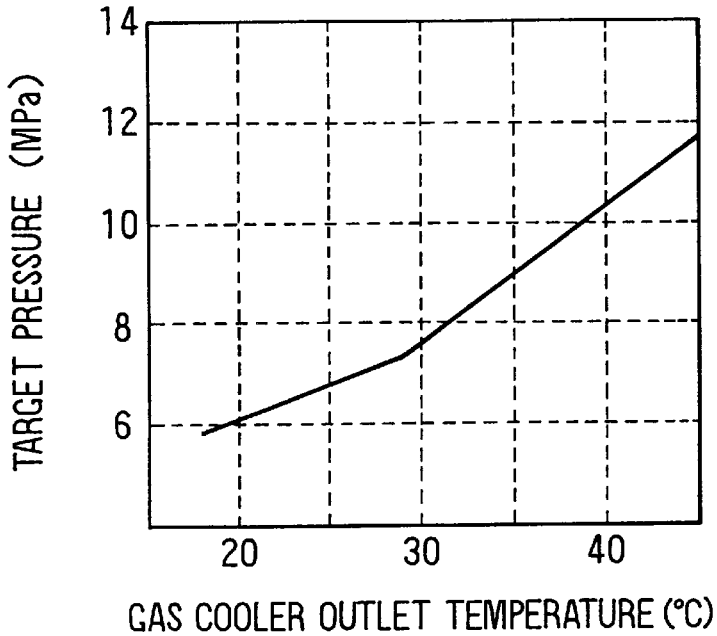
FIG. 26 PRIOR ART
FIG. 26 is a graph showing a relationship between a temperature of $CO_2$ on the outlet side of the gas cooler and a target pressure on the outlet side of the gas cooler to explain the problem in the prior art.
Figure 27:
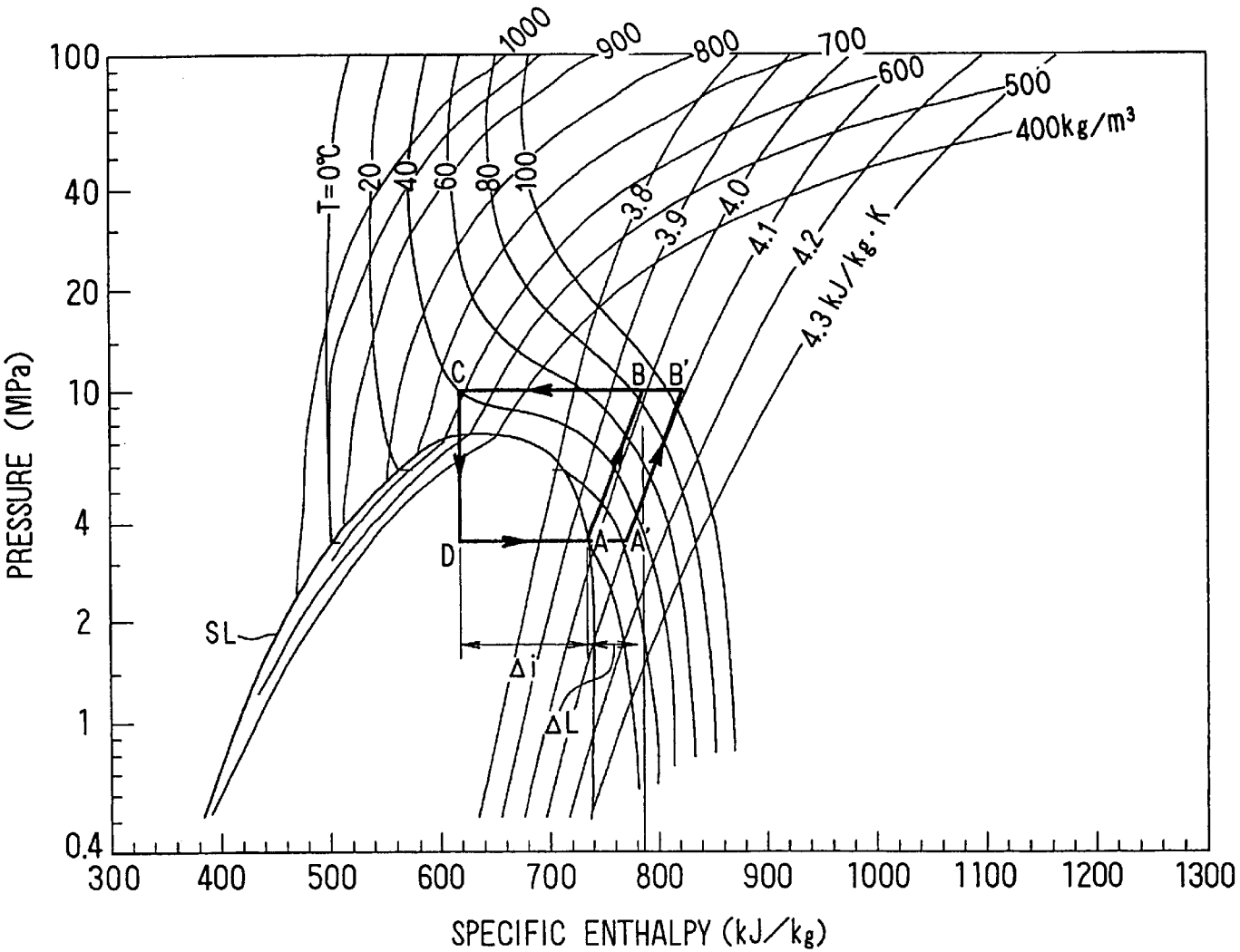
FIG. 27 PRIOR ART
FIG. 27 is a Mollier diagram of $CO_2$ to explain the problem in the prior art.

A ninth embodiment of the present invention is shown in FIGS. 22 and 23.

In the ninth embodiment, a constant pressure regulating valve (bypass valve) 1007 is closed and the internal heat exchanger 600 is used when the low-pressure $CO_2$ is high such as A-B-C-D in FIG. 15.

The constant pressure regulating valve 1007 is opened to bypass the internal heat exchanger 600 when the low-pressure $CO_2$ is low such as E-B-F-G in FIG. 15. Therefore, the raise in the discharge temperature is prevented, and thus, the damage to the compressor 100 is prevented.

The details of the structure of the constant pressure regulating valve 1007 is shown in FIG. 23. The outlet pressure of the accumulator 500 (low-pressure) is introduced into a lower chamber 1103. When the pressure in the lower chamber 1103 becomes, for example, 4 MPa or less, a valve 1102 is opened against the spring force of a spring 1104.

According to the ninth embodiment, the bypass passage is opened to bypass the internal heat exchanger 600 when the pressure of the low-pressure $CO_2$ is lower than certain value. Therefore, the damage to the compressor 100 is prevented. The low-pressure $CO_2$can be any value within the range of the cycle.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A supercritical refrigerating apparatus comprising:

a compressor for compressing refrigerant;

a gas cooler for cooling said refrigerant discharged from said compressor, said gas cooler having an inside pressure exceeding a critical pressure of said refrigerant;

a pressure control unit for decompressing said refrigerant discharged from said gas cooler and for controlling a pressure of said refrigerant on an outlet side of said gas cooler according to a temperature of said refrigerant on the outlet side of said gas cooler;

an evaporator for evaporating said refrigerant decompressed by said pressure control unit;

a gas-liquid separator which separates said refrigerant discharged from said evaporator into gas phase refrigerant and liquid phase refrigerant, and discharges said gas phase refrigerant toward a suction side of said compressor;

a heat exchanger having a first refrigerant passage for a flow of said refrigerant discharged from said gas cooler, and having a second refrigerant passage for a flow of said gas phase refrigerant discharged from said gas-liquid separator, for performing heat exchange between said gas phase refrigerant discharged from said gas-liquid separator and said refrigerant discharged from said gas cooler;

refrigerant bypass means for bypassing one of said first and second refrigerant passages of said heat exchanger according to a physical value of said refrigerant, wherein;

said physical value is a temperature of said refrigerant at a predetermined point between an outlet of said compressor and an inlet of said pressure control unit; and said refrigerant bypass means bypasses one of said first and second refrigerant passages, when said refrigerant temperature at said predetermined point is higher than a predetermined temperature, such that a temperature of said gas phase refrigerant flows into said suction side of said compressor is decreased.

2. A supercritical refrigerating apparatus according to claim 1, wherein, said refrigerant bypass means includes;

a bypass passage for introducing said gas phase refrigerant discharged from said gas-liquid separator to said compressor by bypassing said heat exchanger;

valve means for opening and closing said bypass passage alternatively;

a temperature sensor for detecting a temperature of said refrigerant discharged from said compressor; and valve control means for opening said valve means when said detected temperature by said temperature sensor is higher than said predetermined temperature.

3. A supercritical refrigerating apparatus according to claim 1, wherein, said refrigerant bypass means includes;

a bypass passage for introducing said refrigerant discharged from said gas cooler to said pressure control unit by bypassing said heat exchanger;

valve means for opening and closing said bypass passage alternatively;

a temperature sensor for detecting a temperature of said refrigerant discharged from said compressor; and valve control means for opening said valve means when said detected temperature by said temperature sensor is higher than said predetermined temperature.

4. A supercritical refrigerating apparatus comprising:

a compressor for compressing refrigerant;

a gas cooler for cooling said refrigerant discharged from said compressor, said gas cooler having an inside pressure exceeding a critical pressure of said refrigerant;

a pressure control unit for decompressing said refrigerant discharged from said gas cooler and for controlling a pressure of said refrigerant on an outlet side of said gas cooler according to a temperature of said refrigerant on the outlet side of said gas cooler;

an evaporator for evaporating said refrigerant decompressed by said pressure control unit;

a gas-liquid separator which separates said refrigerant discharged from said evaporator into gas phase refrigerant and liquid phase refrigerant, and discharges said gas phase refrigerant toward a suction side of said compressor;

a heat exchanger having a first refrigerant passage for a flow of said refrigerant discharged from said gas cooler, and having a second refrigerant passage for a flow of said gas phase refrigerant discharged from said gas-liquid separator, for performing heat exchange between said gas phase refrigerant discharged from said gas-liquid separator and said refrigerant discharged from said gas cooler;

refrigerant bypass means for bypassing one of said first and second refrigerant passages of said heat exchanger according to a physical value of said refrigerant, wherein;

said physical value is a pressure of said refrigerant at a predetermined point between an outlet of said pressure control unit and an inlet of said compressor; and said refrigerant bypass means bypasses one of said first and second refrigerant passages, when said refrigerant pressure at said predetermined point is lower than a predetermined pressure, such that a temperature of said gas phase refrigerant flows into said suction side of said compressor is decreased.

5. A supercritical refrigerating apparatus according to claim 4, wherein, said refrigerant bypass means includes;

a bypass passage for introducing said gas phase refrigerant discharged from said gas-liquid separator to said compressor by bypassing said heat exchanger;

valve means for opening and closing said bypass passage alternatively;

a pressure detecting means for detecting a pressure of said refrigerant at said suction side of said compressor; and valve control means for opening said valve means when said detected pressure detected by said pressure detecting means is lower than said predetermined pressure.

6. A supercritical refrigerating apparatus according to claim 4, wherein, said refrigerant bypass means includes;

a bypass passage for introducing said refrigerant discharged from said gas cooler to said pressure control unit by bypassing said heat exchanger;

valve means for opening and closing said bypass passage alternatively;

a pressure detecting means for detecting a pressure of said refrigerant at said suction side of said compressor; and valve control means for opening said valve means when said detected pressure detected by said pressure detecting means is lower than said predetermined pressure.

* * * * *